US010339895B2

(12) United States Patent
Tai et al.

(10) Patent No.: US 10,339,895 B2
(45) Date of Patent: Jul. 2, 2019

(54) BRIGHTNESS COMPENSATION CIRCUITRY, AND DISPLAY DEVICE INCLUDING THE SAME

(71) Applicant: NATIONAL CHIAO TUNG UNIVERSITY, Hsinchu (TW)

(72) Inventors: Ya-Hsiang Tai, Toufen Township, Miaoli County (TW); Xuan-Yong Lin, Taipei (TW); Chun-Yi Chang, Jincheng Township, Kinmen County (TW)

(73) Assignee: NATIONAL CHIAO TUNG UNIVERSITY, Hsinchu (TW)

( * ) Notice: Subject to any disclaimer, the term of this patent is extended or adjusted under 35 U.S.C. 154(b) by 354 days.

(21) Appl. No.: 15/372,782

(22) Filed: Dec. 8, 2016

(65) Prior Publication Data

US 2017/0169796 A1 Jun. 15, 2017

(30) Foreign Application Priority Data

Dec. 11, 2015 (TW) ..... 104141622 A

(51) Int. Cl.
*G09G 5/10* (2006.01)
*G09G 3/3233* (2016.01)

(52) U.S. Cl.
CPC ..... *G09G 5/10* (2013.01); *G09G 3/3233* (2013.01); *G09G 2310/0291* (2013.01); *G09G 2320/0295* (2013.01); *G09G 2320/043* (2013.01); *G09G 2320/0626* (2013.01); *G09G 2320/0693* (2013.01); *G09G 2330/021* (2013.01); *G09G 2330/028* (2013.01)

(58) Field of Classification Search
CPC combination set(s) only.
See application file for complete search history.

(56) References Cited

U.S. PATENT DOCUMENTS

| | | | |
|---|---|---|---|
| 6,433,488 | B1 | 8/2002 | Bu |
| 7,432,891 | B2 | 10/2008 | Fruehauf |
| 7,649,514 | B2 | 1/2010 | Choi et al. |
| 8,004,479 | B2 | 8/2011 | White et al. |

(Continued)

OTHER PUBLICATIONS

Patrick Schalberger, et al., "60.4: Distinguished Paper: A Fully Integrated 1" AMOLED Display Using Current Feedback Based on a Five Mask LTPS CMOS Process," Society for Information Display International Symposium Digest of Technocal Papers, May 2010, vol. 41, Issue 1, pp. 905-908.

(Continued)

*Primary Examiner* — Jennifer Mehmood
*Assistant Examiner* — Deeprose Subedi
(74) *Attorney, Agent, or Firm* — Brooks Kushman P.C.

(57) ABSTRACT

A brightness compensation circuitry includes a data-setting switch unit receiving a data-setting signal, a pixel unit including a pixel driving circuit that receives the data-setting signal during a data-input period to generate a driving current, and a compensation circuit receiving the driving current generated by the pixel driving circuit. The compensation circuit controls the data-setting switch unit to conduct or not conduct by determining whether or not a magnitude of the driving current conforms with a criterion that is associated with target brightness of the pixel unit.

18 Claims, 18 Drawing Sheets

(56) References Cited

U.S. PATENT DOCUMENTS

| | | | | |
|---|---|---|---|---|
| 8,279,143 | B2 | 10/2012 | Nathan et al. | |
| 2016/0125811 | A1* | 5/2016 | Park | G09G 3/3258 345/694 |

OTHER PUBLICATIONS

Norbert Fruehauf, et al., "Current Mirror and Current Feedback Driving of Active Matrix Organic Light Emitting Displays," Active-Matrix Flatpanel Displays and Devices (AM-FPD), 2012, pp. 277-280.

Thomas Charisoulis, et al., "A New Feedback Current Programming Architecture for 2T1C AMOLED Displays," Society or Information Display International Symposium Digest of Technocal Paper, Jun. 2013, vol. 44, No. 1, pp. 465-468.

Hai-Jung In, et al., "An Advanced External Compensation System for Active Matrix Organic Light-Emitting Diode Displays With Poly-Si Thin-Film Transistor Backplane," IEEE Transactions on Electron Devices, 2010, vol. 57, No. 11, pp. 3012-3019.

Shahin. J. Ashtiani and Arokia Nathan, "A Driving Scheme for Active-Matrix Organic Light-Emitting Diode Displays Based on Feedback," IEEE Journal of Display Technology, 2006, vol. 2, No. 3, pp. 258-264.

U.-G. Min and O.-K. Kwon, "Real-Time External Sensing and Compensation Method for Organic Light Emitting Diode Displays," Electronics Letters, 2009, vol. 45, No. 24, pp. 1232-1234.

* cited by examiner

BRIGHTNESS COMPENSATION CIRCUITRY, AND DISPLAY DEVICE INCLUDING THE SAME

CROSS-REFERENCE TO RELATED APPLICATIONS

This application claims priority of Taiwanese Application No. 104141622, filed on Dec. 11, 2015.

TECHNICAL FIELD

The disclosure relates to a display device, and more particularly to a display device having pixel driving circuits that operate in subthreshold region in time domain, and that has current compensation mechanism.

BACKGROUND

In a conventional AMOLED (active-matrix organic light-emitting diode) display, pixel units thereof use TFTs (thin-film transistors) that operate in saturation region to drive light emission of OLEDs (organic light-emitting diodes). Such a conventional AMOLED display may have the following drawbacks:

1. Currents generated by TFTs operating in the saturation region are larger than those generated by TFTs operating in subthreshold region. TFTs that operate in the saturation region cannot meet reduced current requirements for display panels of small size and high resolution.

2. TFTs operating in the saturation region have higher power consumption than those operating in the subthreshold region. The problem of high power consumption may become more severe with development trends of high aspect ratio (i.e., a ratio of an area occupied by the OLEDs with respect to the entire display area of a display panel) and high definition (i.e., number of pixel units per unit display area).

3. Due to the lack of current compensation, when threshold voltage drift or degradation occurs in the TFTs and OLEDs, brightness uniformity of the display panel may be adversely affected.

SUMMARY

Therefore, an object of the disclosure is to provide a brightness compensation circuitry that may have lower power consumption.

According to the disclosure, the brightness compensation circuitry includes a data-setting switch unit, a pixel unit and a compensation circuit. The data-setting switch unit has a first terminal disposed to receive a data-setting signal, a second terminal, and a control terminal, and is configured to transmit the data-setting signal from the first terminal to the second terminal thereof when conducting. The pixel unit has a pixel driving circuit that is coupled to the second terminal of the data-setting switch unit, and that is configured to receive the data-setting signal from the second terminal of the data-setting switch unit during a data-input period, and to generate a driving current according to the data-setting signal thus received. The compensation circuit is coupled to the control terminal of the data-setting switch unit, is coupled to the pixel unit for receiving the driving current generated by the pixel driving circuit, and is configured to control the data-setting switch unit to conduct or not conduct by determining whether or not a magnitude of the driving current conforms with a criterion that is associated with target brightness of the pixel unit.

Another object of the disclosure is to provide a display device that may have lower power consumption.

According to the disclosure, the display device includes a plurality of scan lines disposed along a row direction, a plurality of data lines disposed along a column direction that is transverse to the row direction, and a plurality of brightness compensation circuitries respectively corresponding to the data lines. Each of the brightness compensation circuitries includes a data-setting switch unit, a plurality of pixel units and a compensation circuit.

The data-setting switch unit has a first terminal disposed to receive a data-setting signal, a second terminal coupled to a corresponding one of the data lines, and a control terminal, and is configured to transmit the data-setting signal from the first terminal to the second terminal thereof when conducting. The pixel units are respectively coupled to the scan lines. Each of the pixel units includes a pixel driving circuit that is coupled to the second terminal of the data-setting switch unit, and that is configured to receive the data-setting signal from the second terminal of the data-setting switch unit during a data-input period in which a respective one of the scan lines is driven and the data-setting switch unit is conducting, and to generate a driving current according to the data-setting signal thus received. The compensation circuit is coupled to the control terminal of the data-setting switch unit, is coupled to the pixel units for receiving the driving current generated by the pixel driving circuit of each of the pixel units, and is configured to control the data-setting switch unit to conduct or not conduct by determining whether or not a magnitude of the driving current thus received conforms with a criterion that is associated with target brightness of one of the pixel units of which the pixel driving circuit generates the driving current thus received.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
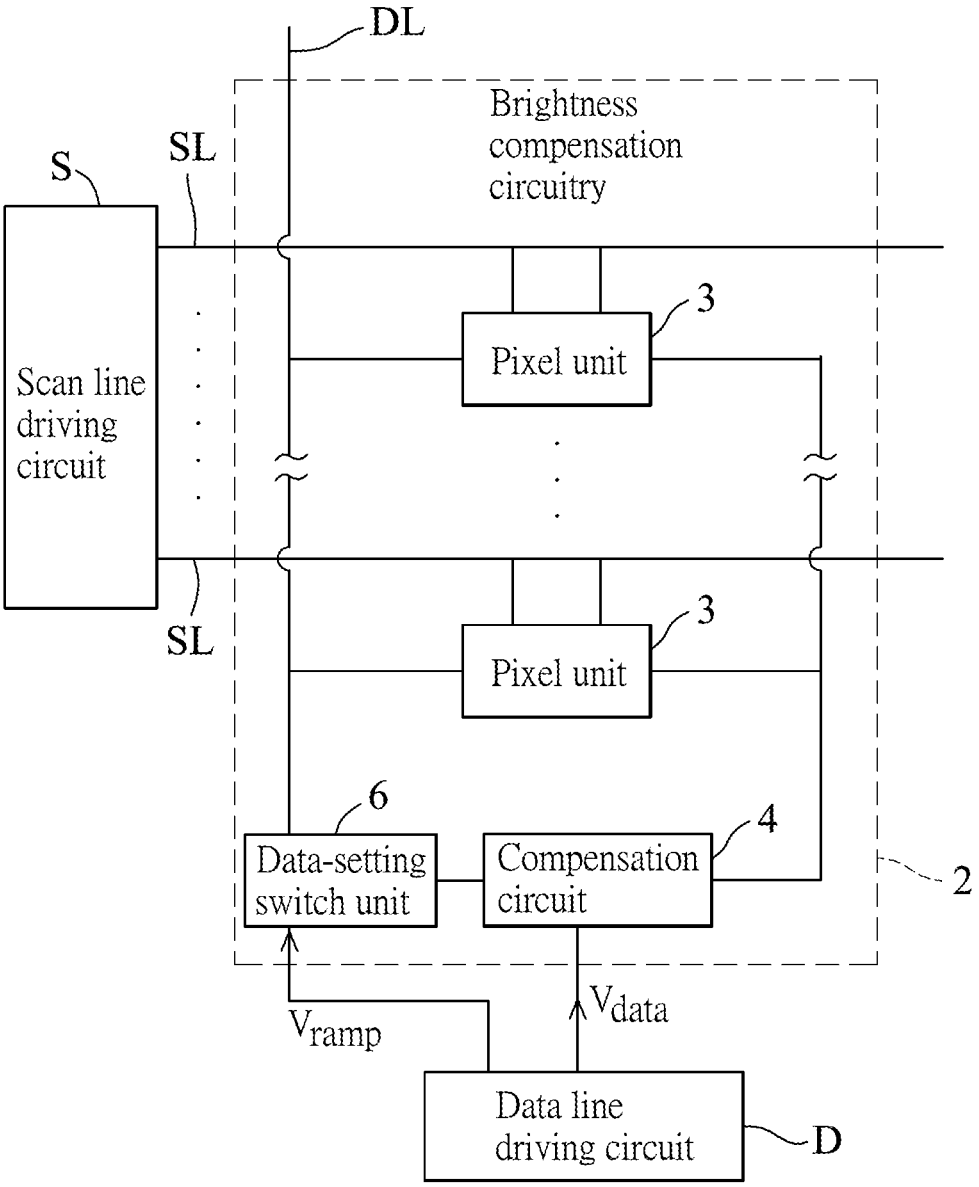
FIG. 1 is a schematic block diagram illustrating an embodiment of a display device according to the disclosure.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIG. 1, the embodiment of the display device having current compensation mechanism according to this disclosure is shown to include a non-conducting substrate (not shown) that is made of, for example, a glass material or a plastic material, a plurality of scan lines (SL), a plurality of data lines (DL), a scan line driving circuit (S), a data line driving circuit (D), and a plurality of brightness compensation circuitries 2 respectively corresponding to the data lines (DL). The scan lines (SL) and the data lines (DL) are formed on the non-conducting substrate. It is noted that, only one data line (DL) and one brightness compensation circuitry 2 is depicted in FIG. 1 for the sake of clarity and simplicity of illustration.

The scan lines (SL) are parallel to each other, and are disposed along a row direction. The data lines (DL) are parallel to each other, and are disposed along a column direction transverse to the row direction. The scan line driving circuit (S) is coupled to the scan lines (SL), and drives the scan lines (SL) in a scanning manner. The data line driving circuit (D) is coupled to the data lines (DL), generates a data-setting signal ($V_{ramp}$) which is a periodic ramp signal in this embodiment (see FIG. 4), and generates data voltages ($V_{data}$) which are to be respectively provided to the brightness compensation circuitries 2.

Figure 2:
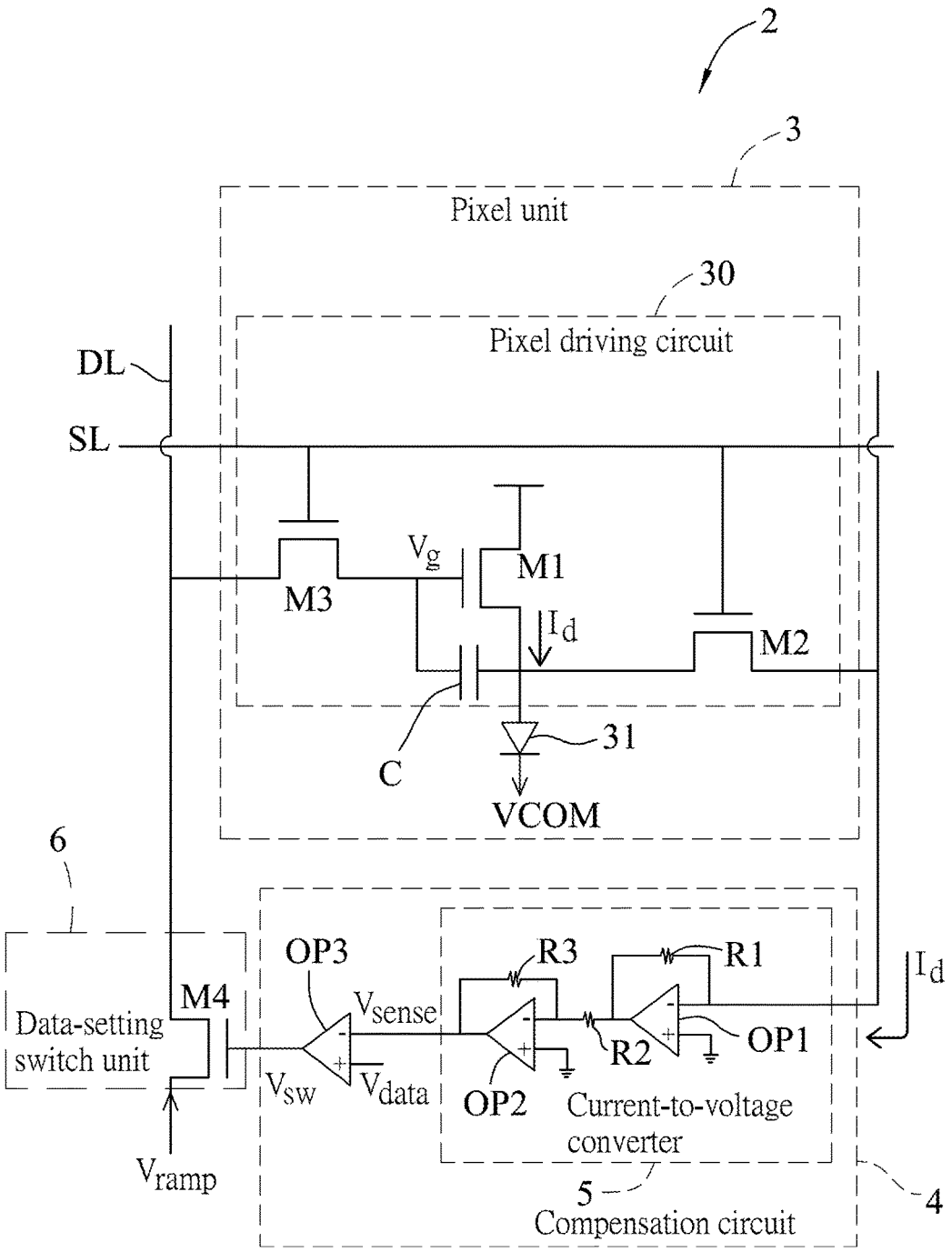
FIG. 2 is a schematic circuit diagram illustrating a first implementation of a brightness compensation circuit of the embodiment.

Further referring to FIG. 2 which illustrates a first implementation of the brightness compensation circuitries 2, each of the brightness compensation circuitries 2 includes a data-setting switch unit 6, a plurality of pixel units 3 and a compensation circuit 4. In this embodiment, the data-setting switch unit 6 and the pixel units 3 are formed on the non-conducting substrate, and the compensation circuit 4 is integrated with the scan line driving circuit (S) and the data line driving circuit (D) in a driver IC chip, but this disclosure is not limited thereto. It is noted that only one pixel unit 3 is shown in FIG. 2 for the sake of simplicity. In the following paragraphs, the description is given with respect to one brightness compensation circuitry 2, if not otherwise specified.

In this embodiment, the data-setting switch unit 6 is a data-setting switch (M4). The data-setting switch (M4) has a first terminal disposed to receive the data-setting signal ($V_{ramp}$), a second terminal coupled to a corresponding data line (DL), and a control terminal, and is configured to transmit the data-setting signal ($V_{ramp}$) from the first terminal to the second terminal thereof when conducting.

The pixel units 3 are respectively coupled to the scan lines (SL). Each of the pixel units 3 includes a pixel driving circuit 30, a compensation switch (M2) and a light emitting component 31.

The pixel driving circuit 30 is coupled to the second terminal of the data-setting switch (M4), and is configured to receive, from the second terminal of the data-setting switch (M4) during a data-input period in which a respective scan line (SL) is driven and the data-setting switch (M4) is conducting, the data-setting signal ($V_{ramp}$) to serve as a data signal, and to generate a driving current ($I_d$) according to the data signal (i.e., the data-setting signal ($V_{ramp}$) thus received). In this embodiment, the pixel driving circuit 30 includes a driving transistor (M1), a data-input switch (M3) and a pixel capacitor (C).

The driving transistor (M1) has a first terminal disposed to receive a bias voltage, a second terminal at which the driving current ($I_d$) is generated, and a control terminal.

The data-input switch (M3) has a first terminal coupled to the second terminal of the data-setting switch (M4), a second terminal coupled to the control terminal of the driving transistor (M1), and a control terminal coupled to the respective scan line (SL). When the data-setting switch (M4) conducts and the respective scan line (SL) is driven to make the data-input switch (M3) conducting (i.e., during the data-input period), the data-setting signal ($V_{ramp}$) is provided to the control terminal of the driving transistor (M1) and serves as the data signal.

The pixel capacitor (C) is coupled between the control terminal and the second terminal of the driving transistor (M1).

The compensation switch (M2) has a first terminal coupled to the second terminal of the driving transistor (M1), a second terminal coupled to the compensation circuit 4 for providing the driving current ($I_d$) thereto, and a control terminal coupled to the respective scan line (SL).

The light emitting component 31 is coupled to the pixel driving circuit 30 for receiving the driving current therefrom, and is configured to emit light according to the driving current thus received. In this embodiment, the light emitting component 31 includes an OLED having an anode coupled to the second terminal of the driving transistor (M1), and a cathode receiving a common voltage (VCOM).

Figure 3:
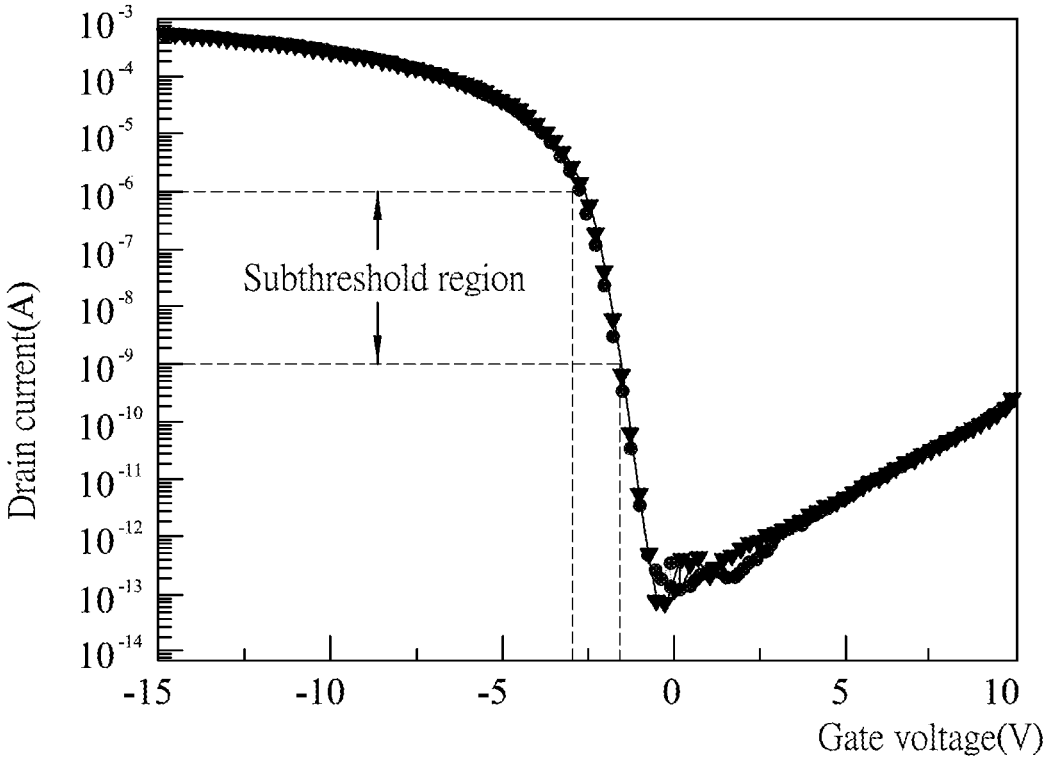
FIG. 3 is a plot illustrating characteristic curves of P-type LTPS (low temperature poly-silicon) TFTs.

In this embodiment, each of the driving transistor (M1), the compensation switch (M2), the data-input switch (M3), and the data-setting switch (M4) is an N-type TFT having a drain node to serve as the first terminal thereof, a source node to serve as the second terminal thereof, and a gate node to serve as the control terminal thereof. In some embodiments, the data-setting switch (M4) may be an N-type MOSFET integrated with the compensation circuit 4 and the data line driving circuit (D) in the driver IC chip. In this embodiment, switching of the data-setting switch (M4) is precisely controlled at specific time points in time domain, such that the driving transistor (M1) operates in the subthreshold region. FIG. 3 is a plot illustrating characteristic curves of P-type LTPS TFTs of a display device with a definition of 300 ppi (pixels per inch), where drain currents of the TFTs are between $10^{-6}$ A and $10^{-9}$ A when the TFTs operate in the subthreshold region.

The compensation circuit 4 is coupled to the control terminal of the data-setting switch (M4), is coupled to the pixel units 3 of the corresponding brightness compensation circuitry 2 for receiving the driving current ($I_d$) generated by the pixel driving circuit 30 of each of the pixel units 3, and outputs a switch signal ($V_{sw}$) to the control terminal of the data-setting switch (M4) to control the data-setting switch (M4) to conduct or not conduct by determining whether or not a magnitude of the driving current ($I_d$) thus received conforms with a criterion that is associated with target brightness of one of the pixel units 3 of which the pixel driving circuit 30 generates the driving current ($I_d$) thus received.

In this embodiment, the compensation circuit 4 includes a current-to-voltage converter 5 and a comparator. The current-to-voltage converter 5 is coupled to the second terminal of the compensation switch (M2) of each of the pixel units 3 of the corresponding brightness compensation circuitry 2 for receiving the driving current ($I_d$) therefrom, and is configured to convert the driving current ($I_d$) thus received into a sensing voltage ($V_{sense}$). In this embodiment, the current-to-voltage converter 5 includes two operational amplifiers (OP1, OP2) and three resistors (R1, R2, R3).

The operational amplifier (OP1) has a first input (−, referring to an inverting input) coupled to the second terminal of the compensation switch (M2), a grounded second input (+, referring to a non-inverting input) and an output. The resistor (R1) is coupled between the first input (−) and the output of the operational amplifier (OP1). The resistor (R2) has a first terminal, and a second terminal coupled to the output of the operational amplifier (OP1). The operational amplifier (OP2) has a first input (−) coupled to the first terminal of the resistor (R2), a grounded second input (+), and an output at which the sensing voltage ($V_{sense}$) is outputted. The resistor (R3) is coupled between the first input (−) and the output of the operational amplifier (OP2).

In this embodiment, the comparator is implemented using an operational amplifier (OP3) that has a first input (−) coupled to the current-to-voltage converter 5 for receiving the sensing voltage ($V_{sense}$) therefrom, a second input (+) receiving the data voltage ($V_{data}$) associated with the target brightness, and an output coupled to the control terminal of the data-setting switch (M4) for providing the switch signal ($V_{sw}$) thereto. The comparator compares the sensing voltage ($V_{sense}$) and the data voltage ($V_{data}$), and controls the data-setting switch (M4) to not conduct when the sensing voltage ($V_{sense}$) is equal to the data voltage ($V_{data}$), and to conduct when the sensing voltage ($V_{sense}$) has not reached the data voltage ($V_{data}$). In this embodiment, a negative feedback formed by the operational amplifier (OP2) and the resistor (R3) increases a voltage outputted by the operational amplifier (OP1), facilitating adjustment of the driving current ($I_d$) to a desired magnitude by using the data voltage ($V_{data}$).

As an example, it is assumed that each of the resistors (R1, R2) has a resistance value of R, and the resistor (R3) has a resistance value of N×R, which means that a closed-loop gain of the negative feedback formed by the operational amplifier (OP2) and the resistor (R3) is N. When the sensing voltage ($V_{sense}$) is equal to the data voltage ($V_{data}$) (i.e., $V_{data}=I_d \times R \times N$), the driving current ($I_d$) that is provided by the driving transistor (M1) operating in the subthreshold region may be set to have a desired value according to $I_d=V_{data}/(R \times N)$. Therefore, with the data voltage ($V_{data}$) being provided by the data line driving circuit (D) and fixing of the value of R, the driving current ($I_d$) may be precisely set even if the threshold voltage and the mobility of the driving transistor (M1) change.

Figure 4:
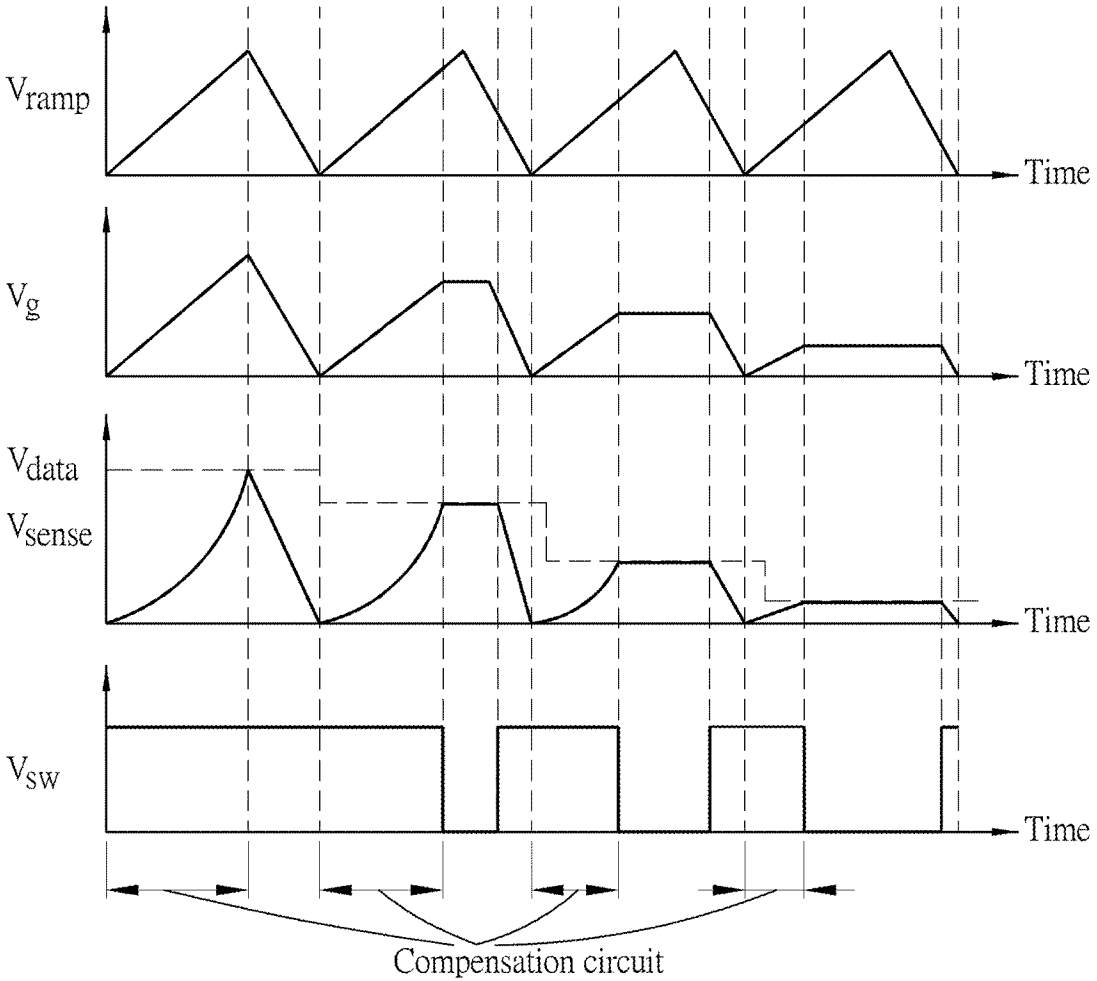
FIG. 4 is a timing diagram for the embodiment.

FIG. 4 is a timing diagram to illustrate a method for control of the pixel unit 3, the compensation circuit 4 and the data-setting switch (M4) by exemplarily performing four consecutive data-input operations on the pixel unit 3. It is noted that the timing diagram in FIG. 4 is obtained by simulation that focuses on interaction of the signals ($V_{ramp}$, $V_g$, $V_{data}$, $V_{sense}$, $V_{sw}$) during a ramp-up period of the data-input signal ($V_{ramp}$), so the signal variation during a ramp-down period of the data-input signal ($V_{ramp}$) may be different in real practice, and a voltage waveform on the scan line (SL) is omitted in FIG. 4. The method uses the compensation circuit 4 to sense the driving current ($I_d$) generated by the driving transistor (M1), and precisely controls timing of cutting off of the rise of the driving current ($I_d$), thereby obtaining the desired target brightness of the OLED, and controlling the driving transistor (M1) to operate in the subthreshold region.

The abovementioned method may include the following steps.

Step (a): Before every data-input period, the data line driving circuit (D) initially provides the data voltage ($V_{data}$) with a high voltage level which is higher than the sensing voltage ($V_{sense}$), so that the switch signal ($V_{sw}$) generated by the comparator causes the data-setting switch (M4) to conduct. It is noted that, this step is optional, and is omitted in this embodiment (not shown in FIG. 4).

Step (b): The data-setting switch (M4) conducts, and transmits the data-setting signal ($V_{ramp}$) that is provided by the data line driving circuit (D) to the second terminal thereof. It is noted that, in this embodiment, a voltage of the data-setting signal ($V_{ramp}$) is designed to linearly increase at a predetermined slope from a predetermined voltage level during a time period in which a voltage level ($V_{scan}$) on the scan line (SL) is high (i.e., the voltage level causing the compensation switch (M2) and the data-input switch (M3) to conduct), and to vary within a predetermined voltage range that causes the driving transistor (M1) (with and without probable threshold voltage drift) to operate in the subthreshold region and that has a tolerance of +/−0.5V, but this disclosure is not limited thereto. In practice, this method may also apply such that the driving transistor (M1) operates in the saturation region through proper design of the data-setting signal ($V_{ramp}$).

Step (c): The scan line driving circuit (S) adjusts the voltage level ($V_{scan}$) on the scan line (SL) to cause the compensation switch (M2) and the data-input switch (M3) to conduct, so that the data-setting signal ($V_{ramp}$) is provided to the control terminal of the driving transistor (M2) and is stored in the pixel capacitor (C). The voltage ($V_g$) at the control terminal of the driving transistor (M1) varies with the data-setting signal ($V_{ramp}$), and the driving transistor (M1) generates the driving current ($I_d$) that varies with the data-setting signal ($V_{ramp}$) (and also the voltage ($V_g$)) and that flows to the compensation circuit 4 through the compensation switch (M2). At this time, since the second terminal of the driving transistor (M1) is coupled to a virtual ground of the operational amplifier (OP1) through the compensation switch (M2), the light-emitting component 31 may be reverse-biased or have equal potentials between the anode and the cathode thereof, and the driving current ($I_d$) does not flow through the light-emitting component 31.

Step (d): The current-to-voltage converter 5 converts the driving current ($I_d$) into the sensing voltage ($V_{sense}$) which has a magnitude proportional to the magnitude of the driving current ($I_d$).

Step (e): The data line driving circuit (D) provides the data voltage ($V_{data}$) associated with/corresponding to the desired target brightness of the pixel unit 3, and the comparator controls the data-setting switch (M4) to not conduct when the sensing voltage ($V_{sense}$) is equal to or higher than the data voltage ($V_{data}$). Then, the voltage ($V_g$) is locked to a voltage of the data-setting signal ($V_{ramp}$) at the time that the data-setting switch (M4) is switched to be non-conducting.

Step (f): The scan line driving circuit (S) adjusts the voltage level ($V_{scan}$) on the scan line (SL) to cause the compensation switch (M2) and the data-input switch (M3) to not conduct when the data-setting signal ($V_{ramp}$) reaches a maximum value. In other words, the voltage level on the scan line (SL) has an on-period equaling a ramp-up period of the data-setting signal ($V_{ramp}$) in practice. Then, the driving transistor (M1) may stably operate in the subthreshold region and provide the driving current ($I_d$) to the light-emitting component 31 according to the voltage ($V_g$) which is locked in step (e).

In this embodiment, the pixel driving circuits 30, the compensation switches (M2), and the data-setting switches (M4) are fabricated using a thin-film process for a panel glass, while the compensation circuit 4 is fabricated using a semiconductor process for a silicon wafer, so as to avoid erroneous outputs of the compensation circuit 4 from drift of TFT characteristics, which may result in incorrect switching timings for the data-setting switches (M4).

Figure 5:
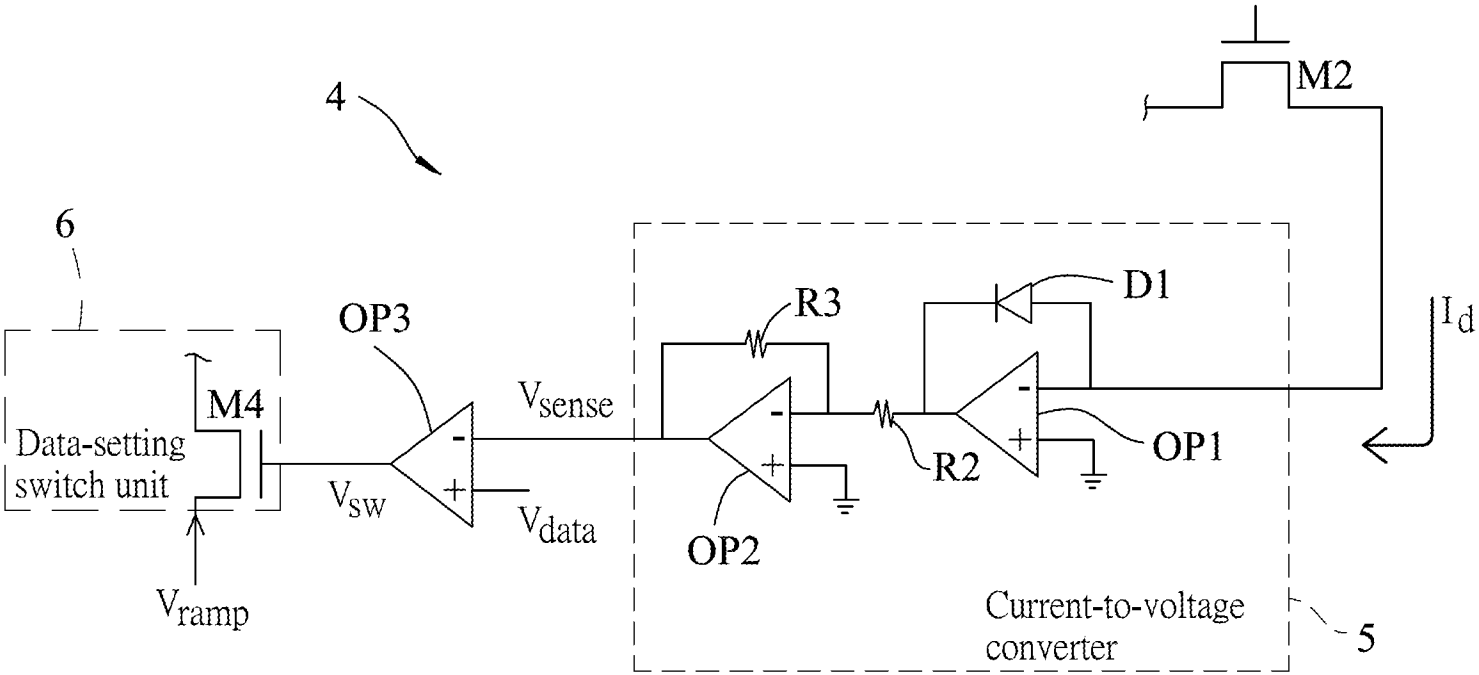
FIG. 5 is a schematic circuit diagram illustrating a first variation of a current-to-voltage converter according to this disclosure.

Referring to FIG. 5, a first variation of the current-to-voltage converter 5 of the compensation circuit 4 is shown to use a diode (D1) to replace the resistor (R1) of the original embodiment (see FIG. 2), where the diode (D1) has an anode and a cathode respectively coupled to the first input (−) and the output of the operational amplifier (OP1). Since the driving current ($I_d$) is so small that, when the resistor (R1) is used, the resistance value of the resistor (R1) may need to be sufficiently large for facilitating control of the data voltage ($V_{data}$). However, a resistor (R1) with a large resistance may have a problem in characteristic matching with the driving transistor (M1). Matching between the driving transistor (M1) and the compensation circuit 4 may be efficiently enhanced by replacing the resistor (R1) of the original embodiment with the diode (D1), and a required magnitude of the data voltage ($V_{data}$) may also thus be reduced.

Figure 6:
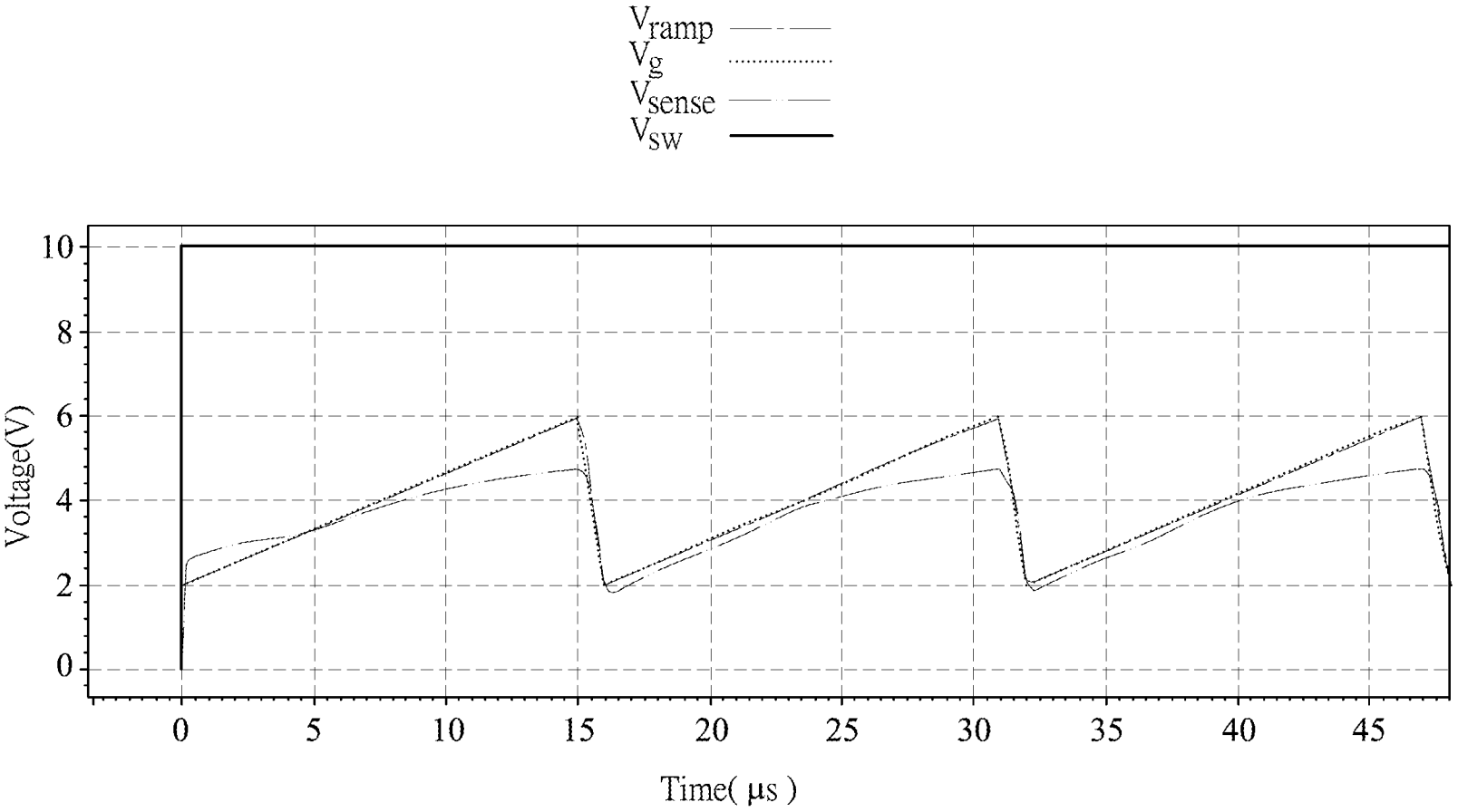
FIG. 6 is a plot illustrating a simulation result of a variation of the embodiment, having the first variation of the current-to-voltage converter.

FIG. 6 shows a simulation result of the embodiment having the first variation of the compensation circuit 4, where a cycle of the data-setting signal ($V_{ramp}$) is 16 μs, the data voltage ($V_{data}$) is set to 5.5V (not shown), the switch signal ($V_{sw}$) is set at 10V to continuously turn on the data-setting switch (M4), a voltage range of the data-setting signal ($V_{ramp}$) is from 2V to 6V, a voltage range of the voltage ($V_g$) is from 2V to 6V, and a voltage range of the sensing voltage ($V_{sense}$) is from 2V to 5V.

Figure 7:
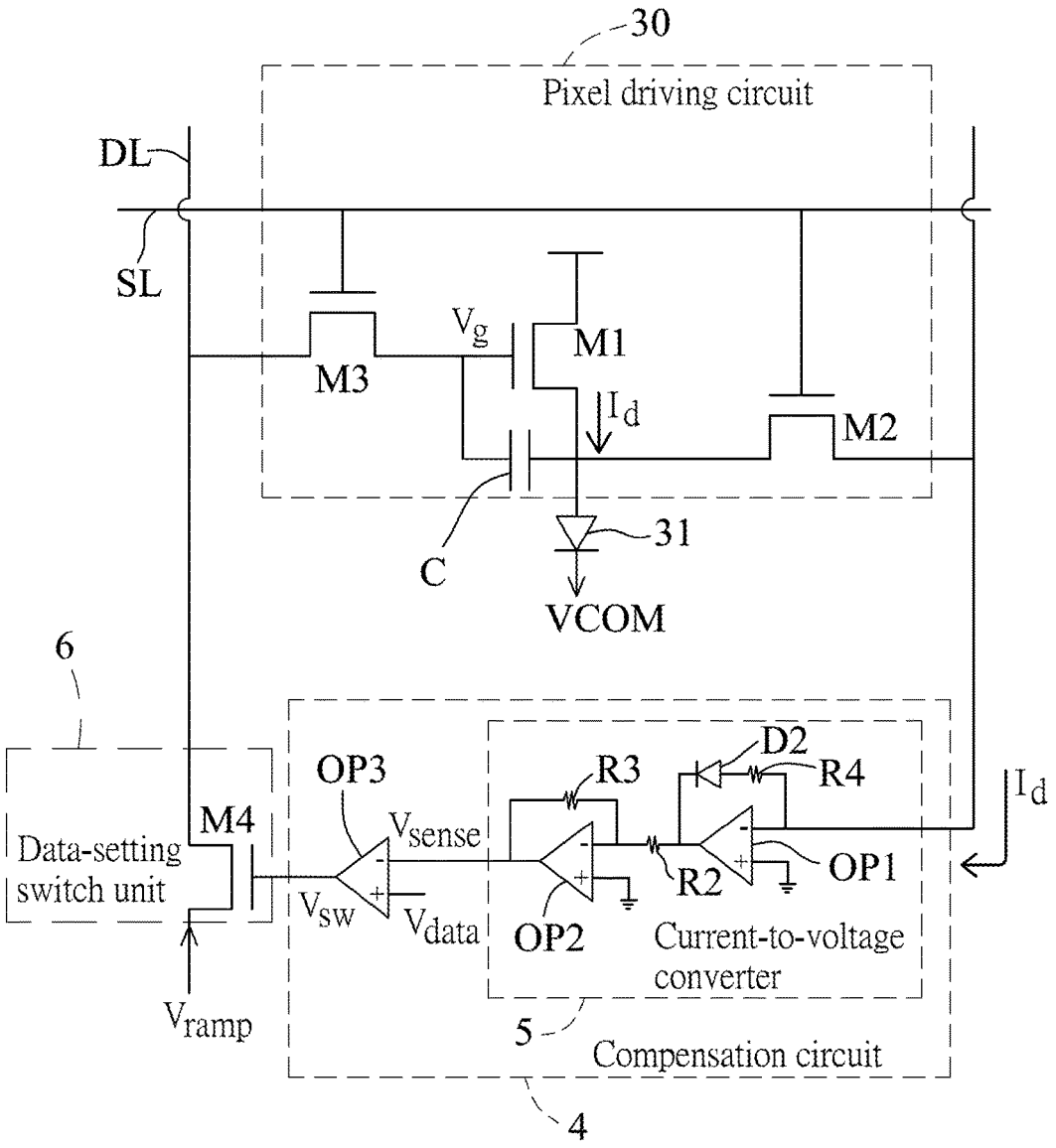
FIG. 7 is a schematic block diagram of a variation of the embodiment, having a second variation of the current-to-voltage converter.

Referring to FIG. 7, a second variation of the current-to-voltage converter 5 of the compensation circuit 4 is shown to use a diode (D2) and a resistor (R4) that are coupled in series to replace the diode (D1) of the first variation (see FIG. 5). Although the diode (D1) of the first variation may effectively resolve a problem that may occur when the driving current ($I_d$) falls within low-current compensation region, the diode (D1) is unable to match the TFTs of the pixel unit 3 in characteristics when the driving current ($I_d$) is large. In the second variation, by virtue of the resistor (R4) coupled in series to the diode (D2), in a low-current region, the diode (D2) may serve as a large resistor, while the resistor (R4) becomes insignificant since resistance thereof is much smaller than that of the diode (D2), and output characteristics of the current-to-voltage converter 5 is mainly determined by the diode (D2). On the other hand, when the driving current ($I_d$) is large, the resistor (R4) cannot be ignored since the diode (D2) acts as a short circuit, and the output characteristics of the current-to-voltage converter 5 is mainly determined by the resistor (R4) at this time. Accordingly, problems resulting from matching between the TFTs and the compensation circuit 4 may be further resolved.

Figure 8:
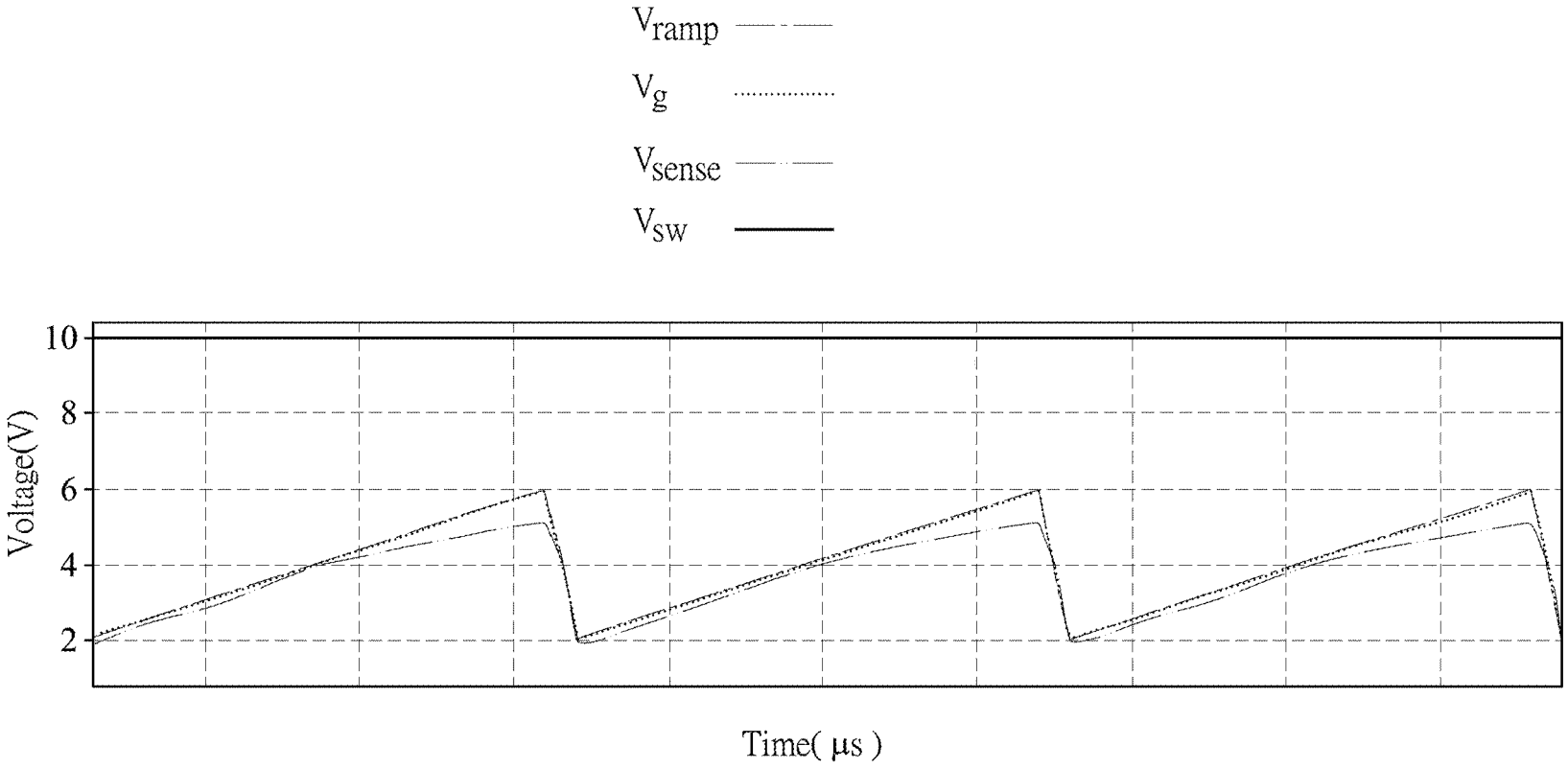
FIG. 8 is a plot illustrating a simulation result of the variation of the embodiment having the second variation of the current-to-voltage converter.

FIG. 8 shows a simulation result of the embodiment having the second variation of the compensation circuit 4, where the data voltage ($V_{data}$) is set to 5.5V (not shown), the switch signal ($V_{sw}$) is set at 10V to continuously turn on the data-setting switch (M4), the voltage range of the data-setting signal ($V_{ramp}$) is from 2V to 6V, the voltage range of the voltage ($V_g$) is from 2V to 6V, and the voltage range of the sensing voltage ($V_{sense}$) is from 2V to 5V.

Figure 9:
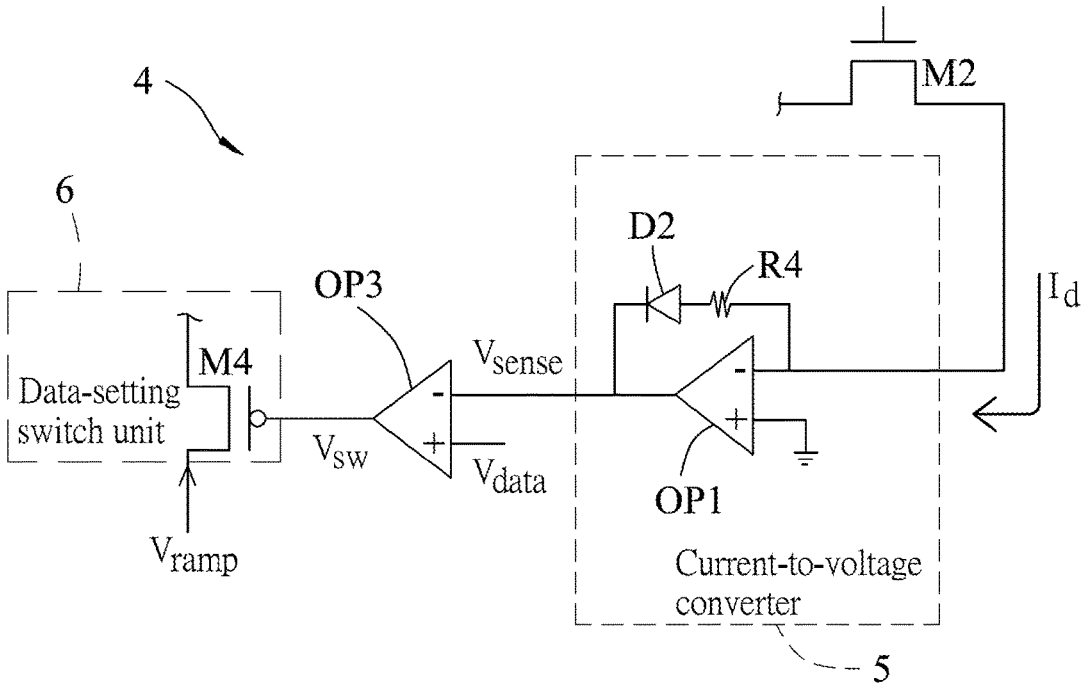
FIG. 9 is a schematic circuit diagram illustrating a third variation of the current-to-voltage converter according to this disclosure.

Referring to FIG. 9, a third variation of the current-to-voltage converter 5 of the compensation circuit 4 is shown to have the operational amplifier (OP2) and the resistors (R2, R3) omitted in comparison with the second variation (see FIG. 7), where a voltage at the output of the operational amplifier (OP1) serves as the sensing voltage ($V_{sense}$), and the first input of the comparator (implemented using the operational amplifier (OP3)) is coupled to the output of the operational amplifier (OP1). Correspondingly, the data-setting switch (M4) is implemented using a P-type MOSFET in this variation. Since the use of the diode (D2) and the resistor (R4) may effectively convert and amplify the driving current ($I_d$), the operational amplifier (OP2) (see FIG. 7), which is used for amplification of a signal outputted by the operational amplifier (OP1), may be omitted.

Figure 10:
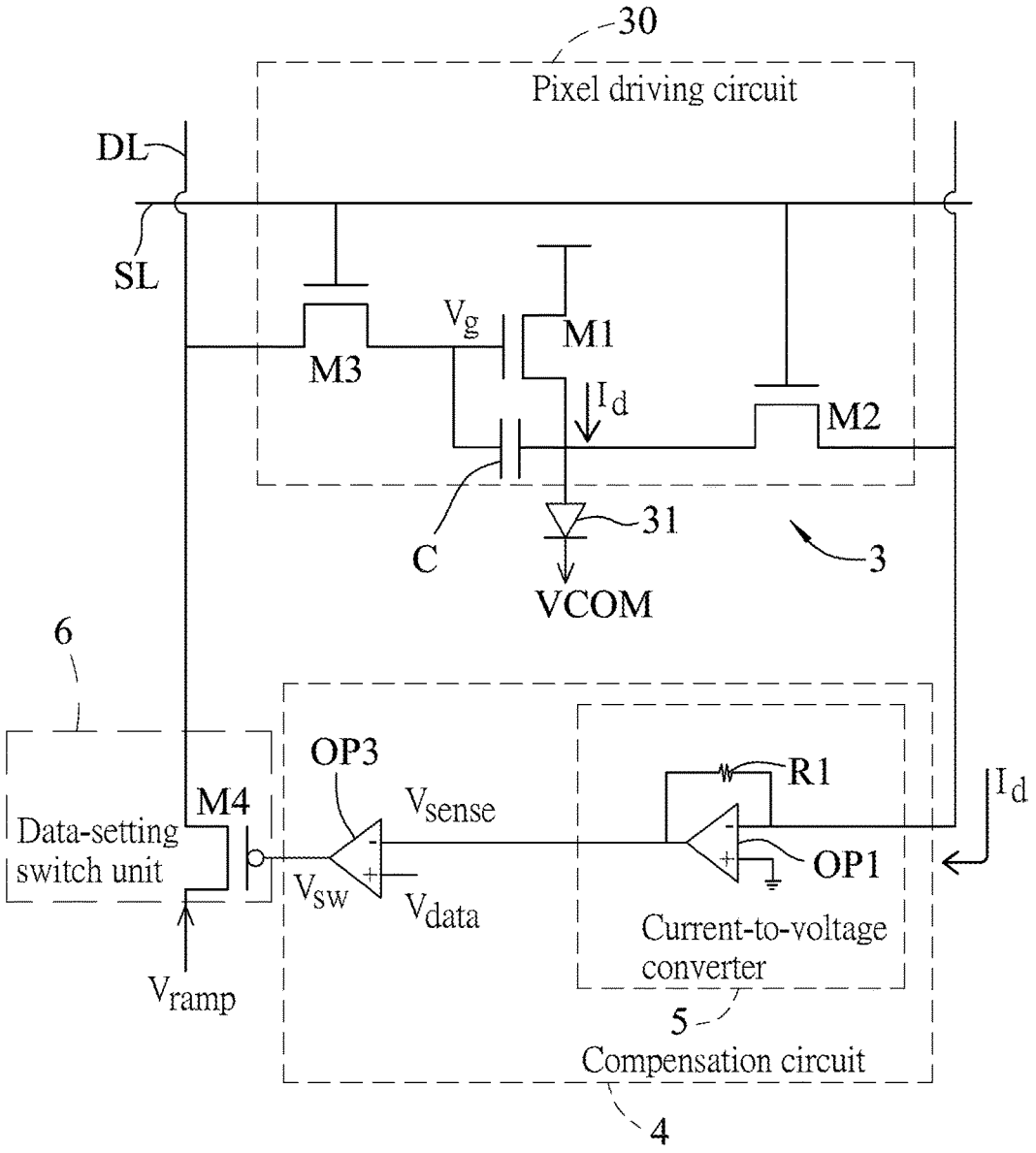
FIG. 10 is a schematic block diagram of a variation of the embodiment, having a fourth variation of the current-to-voltage converter.

Referring to FIG. 10, a fourth variation of the current-to-voltage converter 5 of the compensation circuit 4 is shown to have the operational amplifier (OP2) and the resistors (R2, R3) omitted in comparison with the original embodiment (see FIG. 2).

Figure 11:
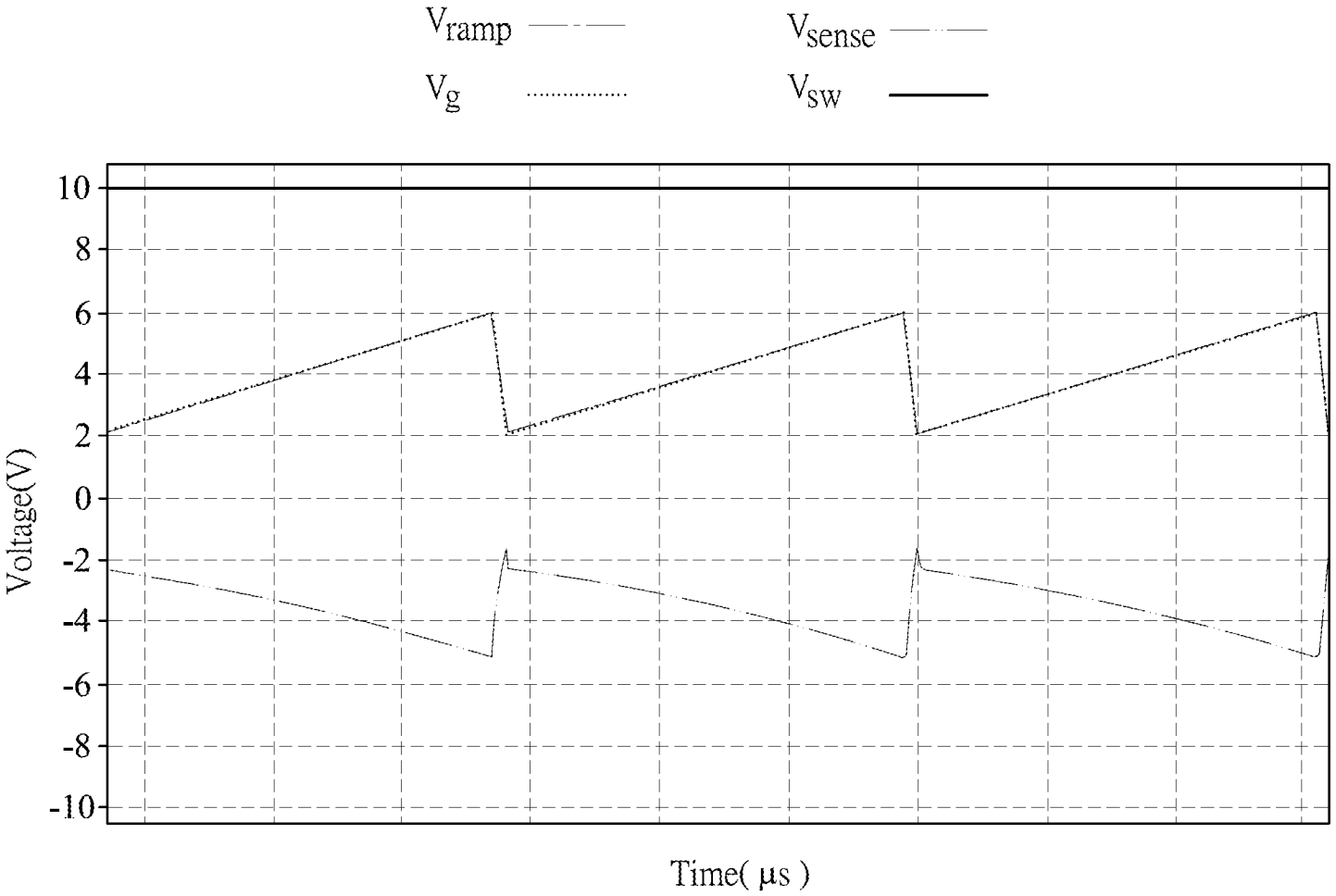
FIG. 11 is a plot illustrating a simulation result of the variation of the embodiment having the fourth variation of the current-to-voltage converter.

FIG. 11 shows a simulation result of the embodiment having the fourth variation of the compensation circuit 4, where the data voltage ($V_{data}$) is set to 0V (not shown), the switch signal ($V_{sw}$) is set at 10V to continuously turn on the data-setting switch (M4), the voltage range of the data-setting signal ($V_{ramp}$) is from 2V to 6V, the voltage range of the voltage ($V_g$) is from 2V to 6V, and a waveform of the sensing voltage ($V_{sense}$) is substantially complementary to that of the voltage ($V_g$), and varies between −2V and −5V.

Figure 12:
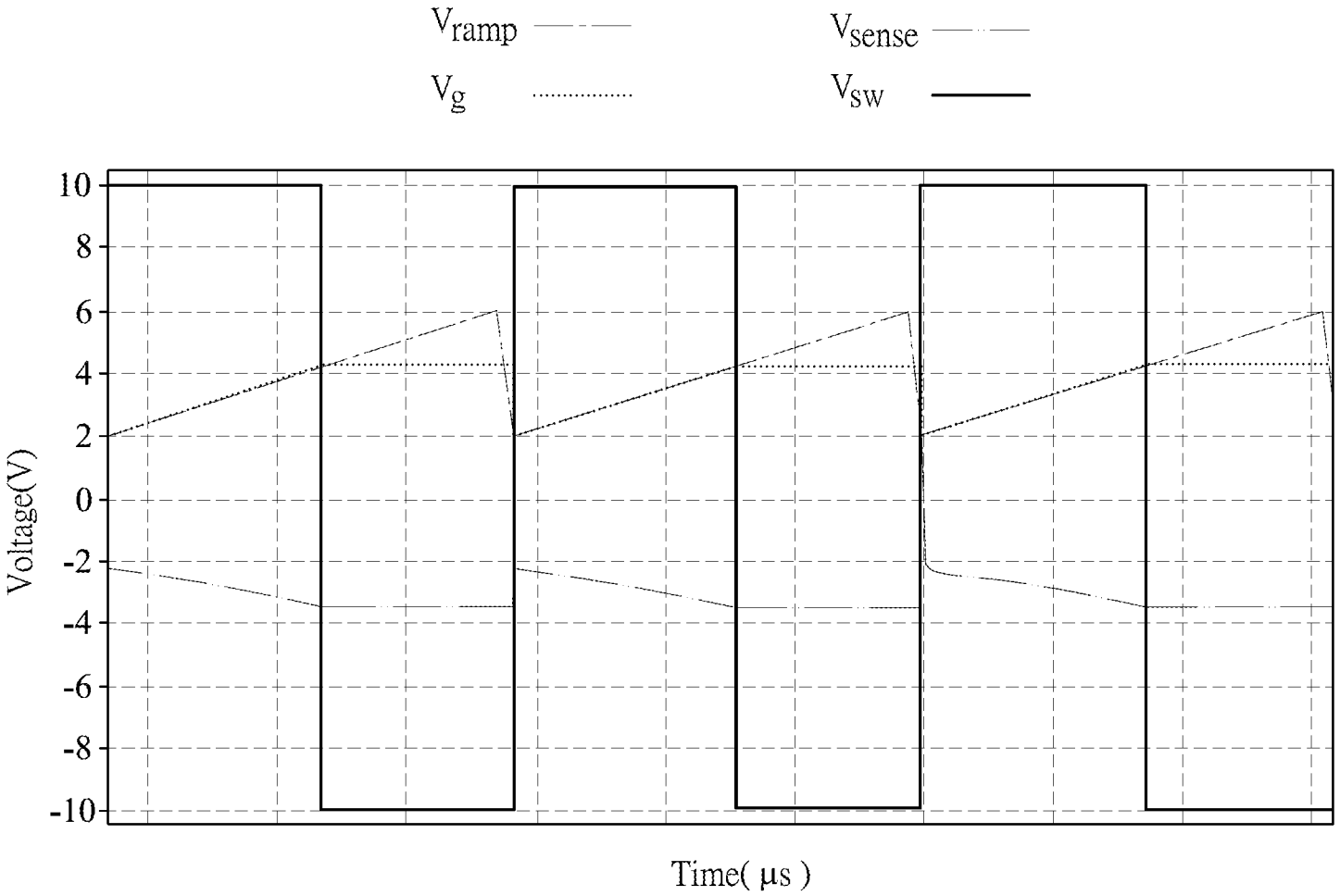
FIG. 12 is a plot illustrating another simulation result of the variation of the embodiment having the fourth variation of the current-to-voltage converter.

FIG. 12 shows another simulation result of the embodiment having the fourth variation of the compensation circuit 4, where the data voltage ($V_{data}$) is set to −3.5V (not shown), the switch signal ($V_{sw}$) is switched between −3V and 10V, the voltage range of the data-setting signal ($V_{ramp}$) is from 2V to 6V, the voltage range of the voltage ($V_g$) is from 2V to 6V, and the voltage range of the sensing voltage ($V_{sense}$) is between −2V and −5V.

Figure 13:
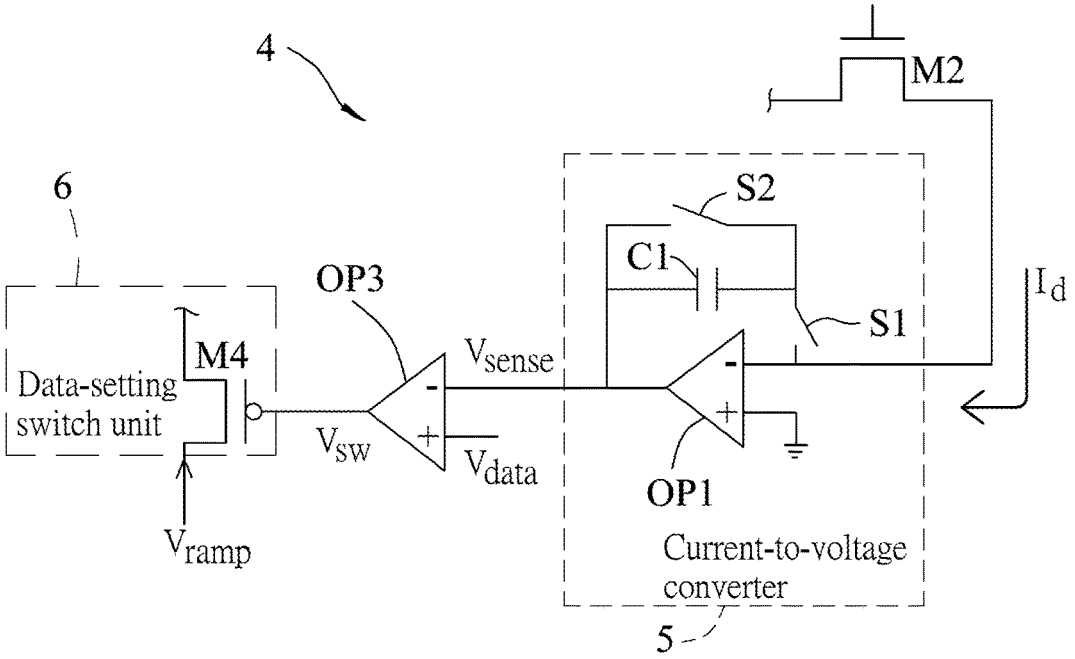
FIG. 13 is a schematic block diagram of a variation of the embodiment, having a fifth variation of the current-to-voltage converter.

Referring to FIG. 13, a fifth variation of the current-to-voltage converter 5 of the compensation circuit 4 is shown to use a switching capacitor technique to mimic the characteristics of the resistor (R1) of the fourth variation (see FIG. 10). In detail, the fifth variation of the current-to-voltage converter 5 includes an operational amplifier (OP1), two switches (S1, S2) and a capacitor (C1).

The operational amplifier (OP1) has a first input (−) coupled to the second terminal of the compensation switch (M2), a grounded second input (+), and an output at which the sensing voltage ($V_{sense}$) is outputted. The switch (S1) has a first terminal coupled to the first input (−) of the operational amplifier (OP1), and a second terminal. The capacitor (C1) is coupled between the second terminal of the switch (S1) and the output of the operational amplifier (OP1). The switch (S2) is coupled in parallel to the capacitor (C1), and conduction and non-conduction thereof are complementary to those of the switch (S1). By adjusting switching frequency of the switches (S1, S2) to control charging-discharging of the capacitor (C1), three different I-V (current to voltage) characteristics may be realized as follows:

1. A stable switching frequency (i.e., a time period between two consecutive switchings is constant) of the switches (S1, S2) may realize an I-V characteristic of a resistor.

2. A gradually reduced switching frequency (i.e., a time period between two consecutive switchings is gradually extended while a pulse-width for a single switching is constant) of the switches (S1, S2) may realize an I-V characteristic of a diode.

3. In a similar way, by properly adjusting the switching frequency of the switches (S1, S2), an I-V characteristic of a diode and a resistor that are coupled in series may be realized.

Figure 14:
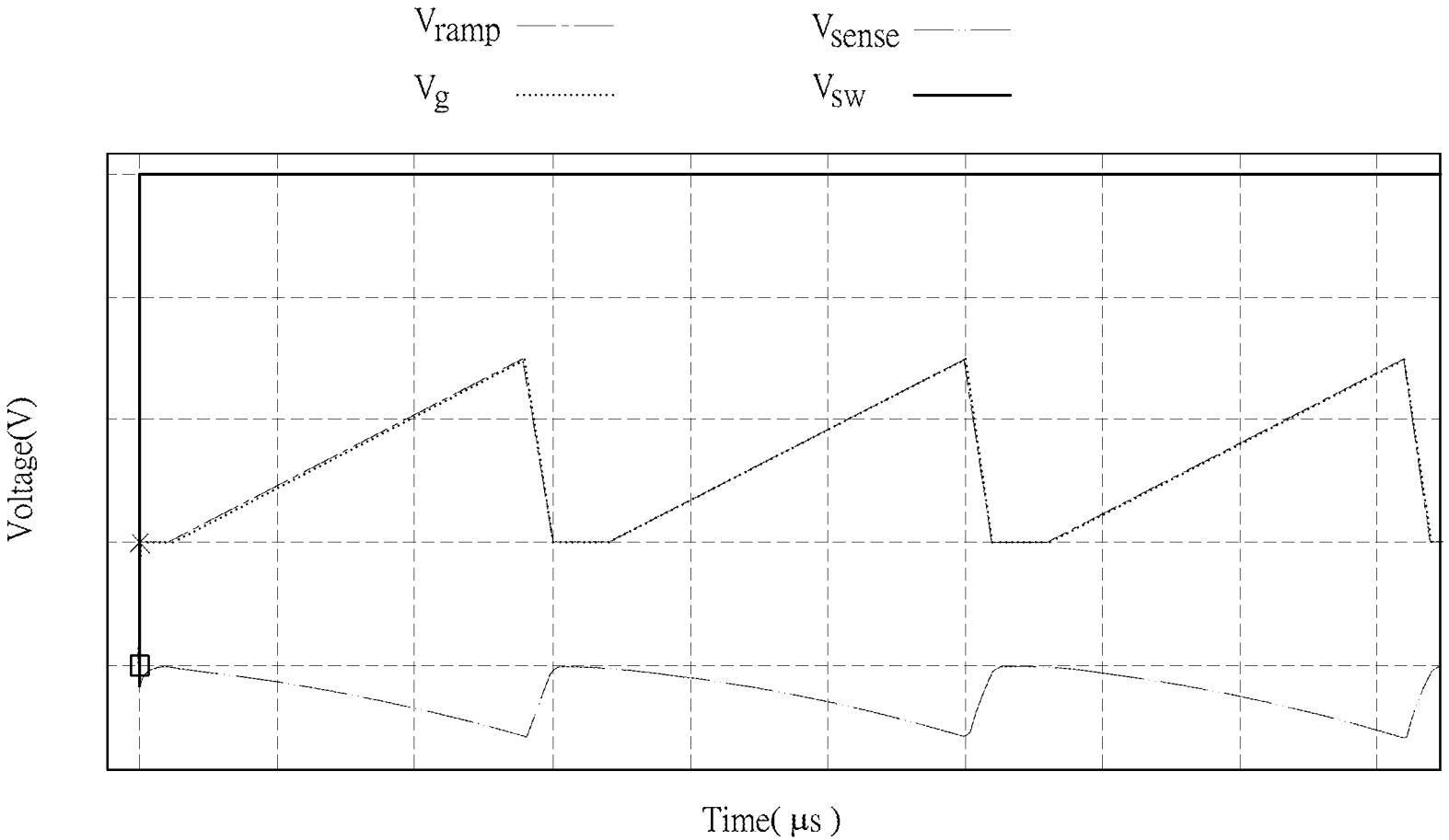
FIG. 14 is a plot illustrating a simulation result of the variation of the embodiment having the fifth variation of the current-to-voltage converter.

FIG. 14 shows a simulation result of the embodiment having the fifth variation of the compensation circuit 4, where the data voltage ($V_{data}$) is set to −4V (not shown), the switch signal ($V_{sw}$) is constantly set at 10V, the voltage range of the data-setting signal ($V_{ramp}$) is from 2V to 5V, the voltage range of the voltage ($V_g$) is from 2V to 5V, and the voltage range of the sensing voltage ($V_{sense}$) is from 0V to −1V.

Figure 15:
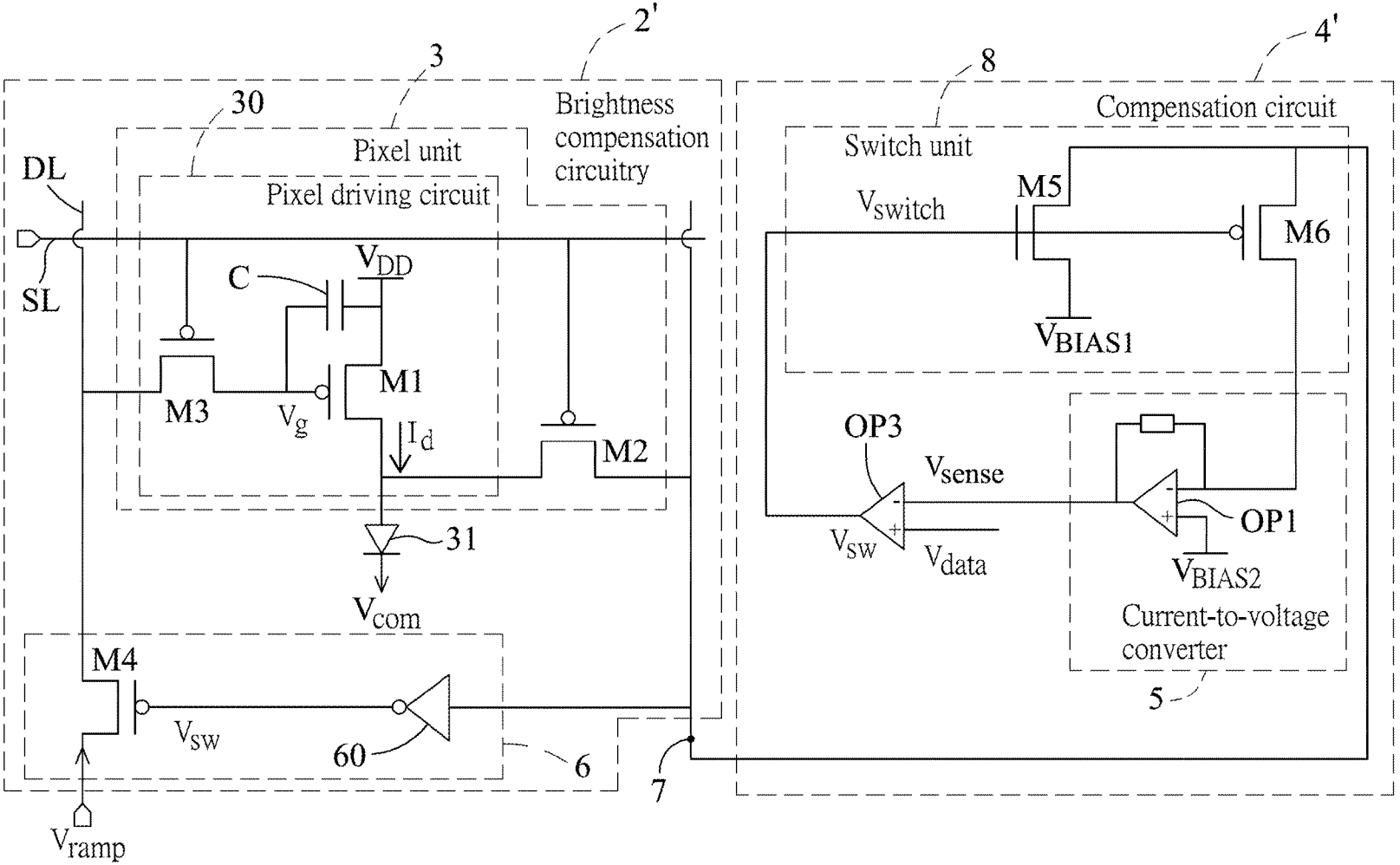
FIG. 15 is a schematic circuit diagram illustrating a second implementation of the brightness compensation circuit of the embodiment.

FIG. 15 illustrates a second implementation of the brightness compensation circuitry 2' which differs from the brightness compensation circuitry 2 (see FIG. 2) in that: each of the transistors (M1-M4) is implemented using a P-type TFT which has a source terminal, a drain terminal and a gate terminal respectively serving as the first, second and control terminals thereof; the pixel capacitor (C) is coupled between the first and control terminals of the driving transistor (M1); the data-setting switch unit 6 is fabricated on the non-conducting substrate, and further includes an inverter 60 which is coupled between the second terminal of the compensation switch (M2) and the control terminal of the data-setting switch (M4); and the brightness compensation circuitry 2' includes a compensation circuit 4' which has a circuit structure different from that of the compensation circuit 4 (see FIG. 2).

The compensation circuit 4' includes the current-to-voltage converter 5 and the comparator of the first implementation as shown in FIG. 2, and further includes an input-output terminal 7 and a switch unit 8.

The input-output terminal 7 is coupled to the second terminal of the compensation switch (M2) for receiving the driving current therefrom, and is coupled to a control terminal of the data-setting switch unit 6, which is an input terminal of the inverter 60, for controlling the data-setting switch unit 6 to conduct or not conduct.

The switch unit 8 has a first terminal coupled to the input-output terminal 7, a second terminal, and a control terminal, and is configured to switch operation between a first state where the switch unit 8 receives the driving current ($I_d$) from the pixel unit 3 through the input-output terminal 7, and makes electrical connection between the first and second terminals thereof, and a second state where the switch unit 8 controls the data-setting switch unit 6 to not conduct through the input-output terminal 7. In this implementation, the switch unit 8 includes switches (M5, M6). The switch (M5) is an N-type transistor that has a first terminal serving as the first terminal of the switch unit 8 and coupled to the input-output terminal 7, a second terminal disposed to receive a first bias voltage ($V_{BIAS1}$) which is a low level voltage, and a control terminal serving as the control terminal of the switch unit 8. The switch (M6) is a P-type transistor that has a first terminal coupled to the input-output terminal 7, a second terminal serving as the second terminal of the switch unit 8, and a control terminal coupled to the control terminal of the switch (M5).

The current-to-voltage converter 5 is coupled to the second terminal of the switch unit 8 for receiving the driving current ($I_d$) therefrom, and is configured to convert the driving current ($I_d$) into a sensing voltage ($V_{sense}$).

The comparator (e.g., the operational amplifier (OP3)) is disposed to receive the data voltage ($V_{data}$) associated with the target brightness, is coupled to the current-to-voltage converter 5 for receiving the sensing voltage ($V_{sense}$) therefrom, has an output terminal coupled to the control terminal of the switch unit 8, and is configured to compare the sensing voltage ($V_{sense}$) and the data voltage ($V_{data}$) so as to control the switch unit 8 to operate in one of the first and second states. It is noted the operational amplifier (OP1) has a non-inverting input receiving a second bias voltage ($V_{BIAS2}$) which is a high level voltage.

Further referring to FIG. 4, during the data-input period, since the sensing voltage ($V_{sense}$) is smaller than the data voltage ($V_{data}$) at the beginning, the comparator controls the switch unit 8 to operate in the first state so the switch (M6) conducts, the driving current ($I_d$) flows into the current-to-voltage converter 5 through the compensation switch (M2), the input-output terminal 7 and the switch (M6), and the sensing voltage ($V_{sense}$) thus approaches the data voltage ($V_{data}$). In this duration, since the inverting input and the non-inventing input of the operational amplifier (OP1) are virtually shorted together, the switch signal ($V_{sw}$) at the input-output terminal 7 is substantially equal to the second bias voltage ($V_{BIAS2}$), causing the data-setting switch (M4) to conduct. When the sensing voltage ($V_{sense}$) has reached the data voltage ($V_{data}$), the comparator controls the switch unit 8 to operate in the second state so the switch (M5) conducts, and the switch signal ($V_{sw}$) is pulled down to the first bias voltage ($V_{BIAS1}$), causing the data-setting switch (M4) to not conduct.

In the second implementation of the brightness compensation circuitry 2', since both the flow of the driving current ($I_d$) into the compensation circuit 4' and the control of the data-setting switch unit 6 are realized through the same input-output terminal 7, only one pin is required for a driver IC to connect the compensation circuit 4' to each data line (DL), and all the data lines (DL) may receive the data-setting signal ($V_{ramp}$) from a common terminal, thereby reducing overall pin counts in comparison to the first implementation of the brightness compensation circuitry 2 (see FIG. 2).

In practice, the data lines (DL) and the scan lines (SL) may induce RC delay that influences transmission of the data-setting signal ($V_{ramp}$), and this RC delay issue is more severe for a large display panel. To overcome this issue, two approaches are introduced as follows.

Figure 16:
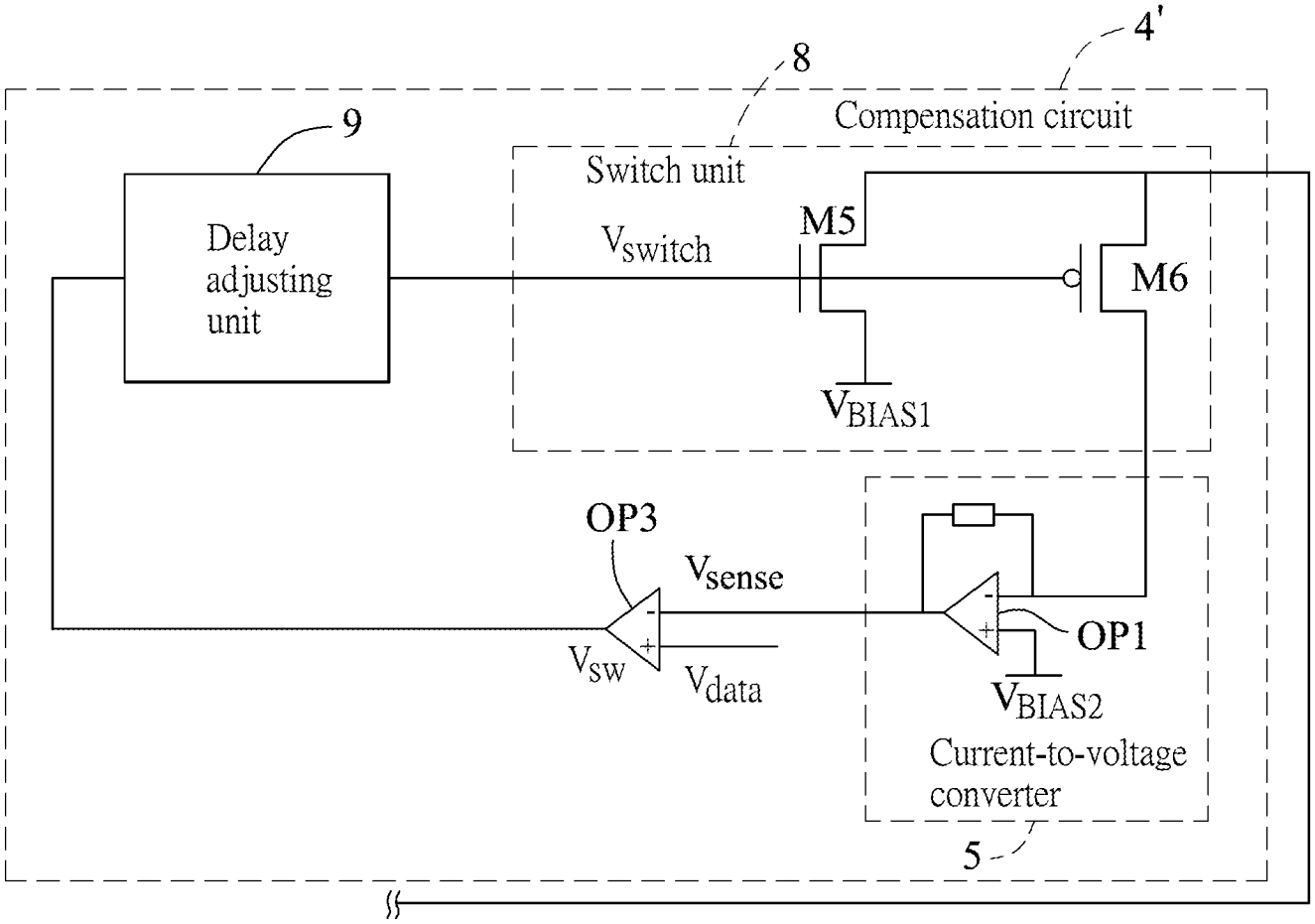
FIG. 16 is a schematic circuit diagram illustrating a first approach to overcome an RC delay issue of the embodiment.

Referring to FIG. 16, in the first approach, the compensation circuit 4' may further include a delay adjusting unit 9 configured to provide delay on signal transmission between the output terminal of the comparator and the control terminal of the switch unit 8, and a length of the delay is associated with a distance between the input-output terminal 7 and the pixel unit 3 which corresponds to the compensation circuit 4' and of which the data-setting switch unit 6 is conducting. In practice, the delay adjusting unit 9 may be implemented using variable resistors, and the resistance of the variable resistors may be adjusted to provide longer delay for the pixel unit 3 that is closer to the compensation circuit 4', and to provide shorter delay for the pixel unit 3 that is farther from the compensation circuit 4'.

Figure 17:
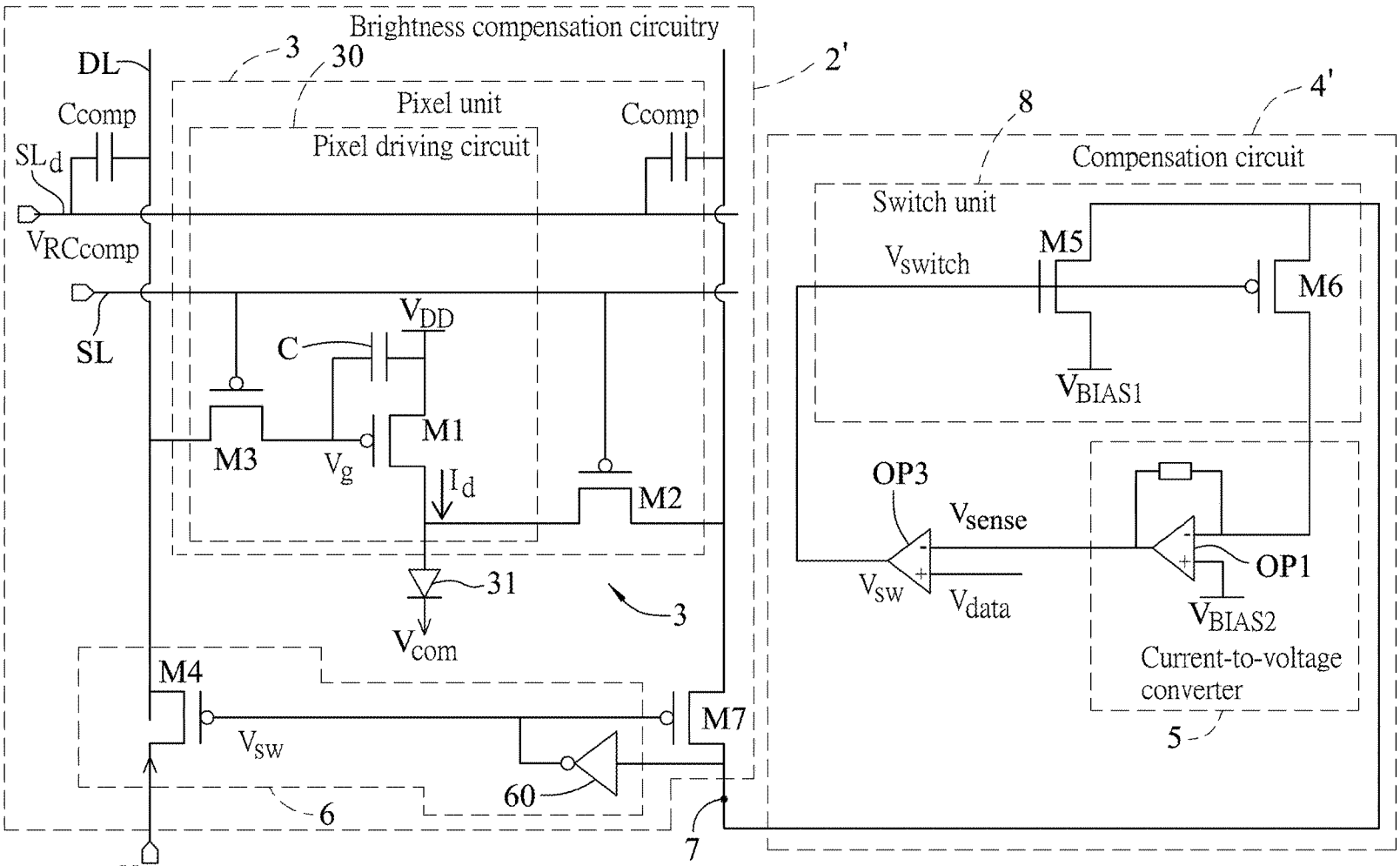
FIG. 17 is a schematic circuit diagram illustrating a second approach to overcome an RC delay issue of the embodiment.
Figure 18:
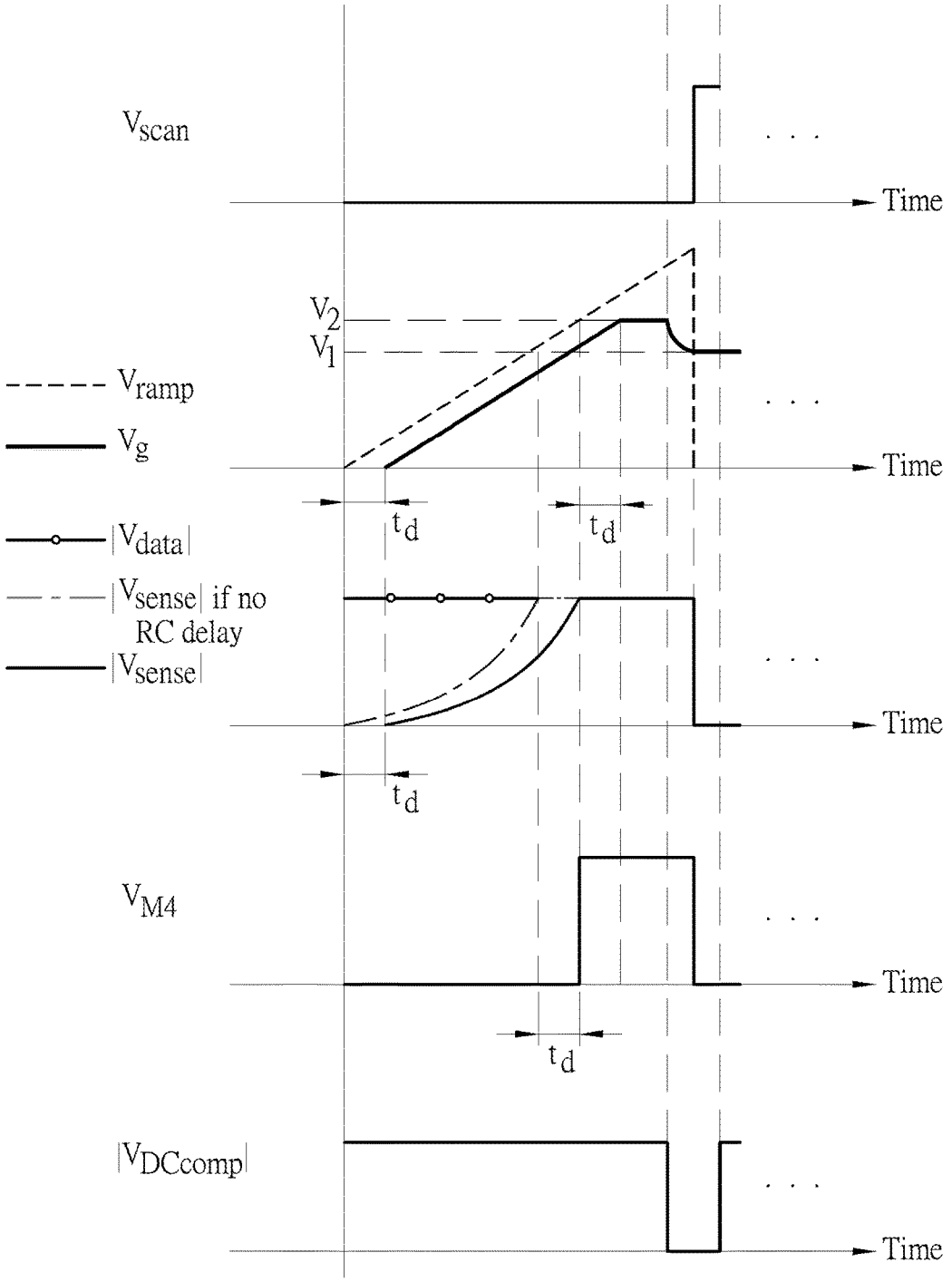
FIG. 18 is a timing diagram illustrating operation of the second approach.

Referring to FIG. 17, in the second approach, additional dummy scan line ($SL_d$) is added to form a predetermined capacitance ($C_{comp}$) with each data line (DL), and is provided with a pulsation compensation signal ($V_{RCcomp}$). In practice, the pulsation compensation signal ($V_{RCcomp}$) may be provided by either the scan line driving circuit (S) or the data line driving circuit (D) (see FIG. 1) as desired, and this disclosure is limited to such. The pulsation compensation signal ($V_{RCcomp}$) has a pulse magnitude varying with a distance between the input-output terminal 7 and one of the scan lines (SL) which is driven. Duration of each of the pulses of the pulsation compensation signal ($V_{RCcomp}$) may be between a first time point after the data-setting switch (M4) transitions to non-conducting, and a second time point after the data-input switch (M3) coupled to the scan line (SL) transitions to non-conducting. FIG. 18 is a timing diagram that exemplifies the second approach. As shown in FIG. 18, the voltage ($V_G$) is expected to have a voltage level of $V_1$ after the data-input period if there is no RC delay. However, the capacitance and resistance along the data line (DL) may delay transition of the data-setting switch (M4) from ON to OFF by a delay time ($t_d$), causing the voltage ($V_G$) to reach a voltage level of $V_2$ which is higher than $V_1$. Therefore, the compensation signal ($V_{RCcomp}$) transitions from a high voltage level to a compensation voltage level, which is lower than the high voltage level, after the data-setting switch (M4) is OFF for coupling the voltage ($V_G$) down to $V_1$, and transitions back to the high voltage level after the data-input switch (M3) is OFF for preventing undesired voltage coupling to the voltage ($V_G$). It is noted that, for the brightness compensation circuitry 2', the compensation voltage level is relatively higher for the pixel unit 3 that is closer to the compensation circuit 4' due to shorter RC delay, and is relatively lower for the pixel unit 3 that is farther from the compensation circuit 4' due to longer RC delay. In addition, in FIG. 17, the brightness compensation circuitry 2' may further include a transistor (M7) between the input-output terminal 7 and the second terminal of the compensation switch (M2) with a control terminal coupled to the control terminal of the data-setting switch (M4) for enhancing control of the data-setting switch unit 6. In summary, the disclosure may achieve the following advantageous effects:

1. Through use of the compensation circuit 4, 4' and the data-setting switch (M4), the driving transistor (M1) may be precisely controlled in the time domain such that the driving transistor (M1) operates in the subthreshold region and thus has a smaller driving current ($I_d$), thereby satisfying reduced current requirement for display panels of small size and high definition, and resolving a problem of high power consumption resulting from the driving transistor operating in the saturation region.

2. The pixel unit 3 includes only three transistors and a capacitor to drive the light emitting component, so development toward high aspect ratio and high definition may be relatively easier.

3. By virtue of current compensation implemented by the compensation circuit 4, 4' and the data-setting switch (M4), the driving current ($I_d$) may be precisely set as desired even if the threshold voltage of the driving transistor (M1) drifts or the mobility of the driving transistor (M1) changes due to degradation.

4. The compensation circuit 4, 4' is fabricated using the semiconductor process for silicon wafers, thereby preventing problems of erroneous driving current settings from characteristic drifts of TFTs.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A brightness compensation circuitry, comprising:

a data-setting switch unit having a first terminal disposed to receive a data-setting signal, a second terminal, and a control terminal, said data-setting switch unit being configured to transmit the data-setting signal from said first terminal to said second terminal thereof when conducting;

a pixel unit including a pixel driving circuit that is coupled to said second terminal of said data-setting switch unit, and that is configured to receive the data-setting signal from said second terminal of said data-setting switch unit during a data-input period, and to generate a driving current according to the data-setting signal thus received; and a compensation circuit coupled to said control terminal of said data-setting switch unit, coupled to said pixel unit for receiving the driving current generated by said pixel driving circuit, and configured to control said data-setting switch unit to conduct or not conduct by determining whether or not a magnitude of the driving current conforms with a criterion that is associated with target brightness of said pixel unit;

wherein said compensation circuit includes:

a current-to-voltage converter coupled to said pixel unit for receiving the driving current generated by said pixel driving circuit, and configured to convert the driving current into a sensing voltage; and a comparator disposed to receive a data voltage associated with the target brightness, coupled to said current-to-voltage converter for receiving the sensing voltage therefrom, having an output terminal coupled to said control terminal of said data-setting switch unit, and configured to compare the sensing voltage and the data voltage, and to control said data-setting switch unit to not conduct when the sensing voltage is equal to the data voltage.

2. The brightness compensation circuitry of claim 1, wherein said pixel unit further includes a compensation switch having a first terminal coupled to said pixel driving circuit for receiving the driving current therefrom, and a second terminal coupled to said compensation circuit, and configured to make or break electrical connection between said first and second terminals thereof.

3. The brightness compensation circuitry of claim 2, wherein said pixel unit further includes a light emitting component coupled to said pixel driving circuit for receiving the driving current therefrom, and configured to emit light according to the driving current thus received.

4. The brightness compensation circuitry of claim 2, wherein said current-to-voltage converter includes:

a first operational amplifier having a first input coupled to said second terminal of said compensation switch, a second input, and an output;

a first resistor coupled between said first input and said output of said first operational amplifier;

a second resistor having a first terminal, and a second terminal coupled to said output of said first operational amplifier;

a second operational amplifier having a first input coupled to said first terminal of said second resistor, a second input, and an output at which the sensing voltage is outputted; and a third resistor coupled between said first input and said output of said second operational amplifier.

5. The brightness compensation circuitry of claim 2, wherein said comparator includes an operational amplifier having a first input coupled to said current-to-voltage converter to receive the sensing voltage therefrom, a second input disposed to receive the data voltage, and an output serving as said output terminal of said comparator.

6. The brightness compensation circuitry of claim 2, wherein said current-to-voltage converter includes:

a first operational amplifier having a first input coupled to said second terminal of said compensation switch, a second input, and an output;

a diode having an anode and a cathode respectively coupled to said first input and said output of said first operational amplifier;

a second resistor having a first terminal, and a second terminal coupled to said output of said first operational amplifier;

a second operational amplifier having a first input coupled to said first terminal of said second resistor, a second input, and an output at which the sensing voltage is outputted; and a third resistor coupled between said first input and said output of said second operational amplifier.

7. The brightness compensation circuitry of claim 2, wherein said current-to-voltage converter includes:

a first operational amplifier having a first input coupled to said second terminal of said compensation switch, a second input, and an output;

a first resistor and a diode coupled in series between said first input and said output of said first operational amplifier;

a second resistor having a first terminal, and a second terminal coupled to said output of said first operational amplifier;

a second operational amplifier having a first input coupled to said first terminal of said second resistor, a second input, and an output at which the sensing voltage is outputted; and a third resistor coupled between said first input and said output of said second operational amplifier.

8. The brightness compensation circuitry of claim 2, wherein said current-to-voltage converter includes:

an operational amplifier having a first input coupled to said second terminal of said compensation switch, a second input, and an output at which the sensing voltage is outputted; and a resistor and a diode coupled in series between said first input and said output of said operational amplifier.

9. The brightness compensation circuitry of claim 2, wherein said current-to-voltage converter includes:

an operational amplifier having a first input coupled to said second terminal of said compensation switch, a second input, and an output at which the sensing voltage is outputted; and a resistor coupled between said first input and said output of said operational amplifier.

10. The brightness compensation circuitry of claim 2, wherein said current-to-voltage converter includes:

an operational amplifier having a first input coupled to said second terminal of said compensation switch, a second input, and an output at which the sensing voltage is outputted;

a first switch having a first terminal coupled to said first input of said operational amplifier, and a second terminal;

a capacitor coupled between said second terminal of said first switch and said output of said operational amplifier; and a second switch coupled in parallel to said capacitor;

wherein conduction and non-conduction of said first switch are complementary to those of said second switch.

11. A brightness compensation circuitry, comprising:

a data-setting switch unit having a first terminal disposed to receive a data-setting signal, a second terminal, and a control terminal, said data-setting switch unit being configured to transmit the data-setting signal from said first terminal to said second terminal thereof when conducting;

a pixel unit including a pixel driving circuit that is coupled to said second terminal of said data-setting switch unit, and that is configured to receive the data-setting signal from said second terminal of said data-setting switch unit during a data-input period, and to generate a driving current according to the data-setting signal thus received; and a compensation circuit coupled to said control terminal of said data-setting switch unit, coupled to said pixel unit for receiving the driving current generated by said pixel driving circuit, and configured to control said data-setting switch unit to conduct or not conduct by determining whether or not a magnitude of the driving current conforms with a criterion that is associated with target brightness of said pixel unit;

wherein said pixel unit further includes a compensation switch having a first terminal coupled to said pixel driving circuit for receiving the driving current therefrom, and a second terminal coupled to said compensation circuit, and configured to make or break electrical connection between said first and second terminals thereof; and wherein said compensation circuit includes:

an input-output terminal coupled to said second terminal of said compensation switch for receiving the driving current therefrom, and coupled to said control terminal of said data-setting switch unit for controlling said data-setting switch unit to conduct or not conduct;

a switch unit having a first terminal coupled to said input-output terminal, a second terminal, and a control terminal, and configured to switch operation between a first state where said switch unit receives the driving current from said pixel unit through said input-output terminal, and makes electrical connection between said first and second terminals thereof, and a second state where said switch unit controls said data-setting switch unit to not conduct through said input-output terminal;

a current-to-voltage converter coupled to said second terminal of said switch unit for receiving the driving current therefrom, and configured to convert the driving current into a sensing voltage; and a comparator disposed to receive a data voltage associated with the target brightness, coupled to said current-to-voltage converter for receiving the sensing voltage therefrom, having an output terminal coupled to said control terminal of said switch unit, and configured to compare the sensing voltage and the data voltage so as to control said switch unit to operate in one of the first and second states.

12. The brightness compensation circuitry of claim 1, wherein said compensation circuit is fabricated using a semiconductor process of silicon wafers.

13. A display device, comprising:

a plurality of scan lines disposed along a row direction;

a plurality of data lines disposed along a column direction that is transverse to the row direction; and a plurality of brightness compensation circuitries respectively corresponding to said data lines, each of said brightness compensation circuitries including:

a data-setting switch unit having a first terminal disposed to receive a data-setting signal, a second terminal coupled to the corresponding one of said data lines, and a control terminal, and configured to transmit the data-setting signal from said first terminal to said second terminal thereof when conducting;

a plurality of pixel units respectively coupled to said scan lines, each of said pixel units including a pixel driving circuit that is coupled to said second terminal of said data-setting switch unit, and that is configured to receive the data-setting signal from said second terminal of said data-setting switch unit during a data-input period in which the respective one of said scan lines is driven and said data-setting switch unit is conducting, and to generate a driving current according to the data-setting signal thus received;

a compensation circuit coupled to said control terminal of said data-setting switch unit, coupled to said pixel units for receiving the driving current generated by said pixel driving circuit of each of said pixel units, and configured to control said data-setting switch unit to conduct or not conduct by determining whether or not a magnitude of the driving current thus received conforms with a criterion that is associated with target brightness of one of said pixel units of which said pixel driving circuit generates the driving current thus received; and a dummy scan line that is parallel to said scan lines, that forms a predetermined capacitance with each of said data lines, and that is disposed to receive a pulsation compensation signal, wherein the pulsation compensation signal has a pause magnitude varying with a distance between said input-output terminal and one of said scan lines which is driven.

14. The display device of claim 13, wherein each of said pixel units further includes a compensation switch having a first terminal coupled to said pixel driving circuit for receiving the driving current therefrom, and a second terminal coupled to said compensation circuit for providing the driving current thereto, and configured to make or break electrical connection between said first and second terminals thereof.

15. The display device of claim 14, wherein said compensation circuit of each of said brightness compensation circuitries includes:

a current-to-voltage converter coupled to said second terminal of said compensation switch of each of said pixel units of a respective one of said brightness compensation circuitries for receiving the driving current therefrom, and configured to convert the driving current thus received into a sensing voltage; and a comparator disposed to receive a data voltage associated with the target brightness, coupled to said current-to-voltage converter for receiving the sensing voltage therefrom, having an output terminal coupled to said control terminal of said data-setting switch unit, and configured to compare the sensing voltage and the data voltage so as to control said data-setting switch unit to conduct or not conduct.

16. The display device of claim 14, wherein said compensation circuit of each of said brightness compensation circuitries includes:

an input-output terminal coupled to said second terminal of said compensation switch of each of said pixel units of a respective one of said brightness compensation circuitries for receiving the driving current therefrom, and coupled to said control terminal of said data-setting switch unit for controlling said data-setting switch unit to conduct or not conduct;

a switch unit having a first terminal coupled to said input-output terminal, a second terminal, and a control terminal, and configured to switch operation between a first state where said switch unit receives the driving current from said pixel unit through said input-output terminal, and makes electrical connection between said first and second terminals thereof, and a second state where said switch unit controls said data-setting switch unit to not conduct through said input-output terminal;

a current-to-voltage converter coupled to said second terminal of said switch unit for receiving the driving current therefrom, and configured to convert the driving current into a sensing voltage; and a comparator disposed to receive a data voltage associated with the target brightness, coupled to said current-to-voltage converter for receiving the sensing voltage therefrom, having an output terminal coupled to said control terminal of said switch unit, and configured to compare the sensing voltage and the data voltage so as to control said switch unit to operate in one of the first and second states.

17. The display device of claim 16, further comprising a non-conducting substrate on which said scan lines, said data lines, and said data-setting switch unit of each of said brightness compensation circuitries are formed.

18. The display device of claim 16, wherein said compensation circuit further includes a delay adjusting unit coupled between said output terminal of said comparator and said control terminal of said switch unit, and configured to provide delay on signal transmission between the said terminal of said comparator and said control terminal of said switch unit, a length of the delay being associated with a distance between said input-output terminal and one of said pixel units of which said data-setting switch unit is conducting.

* * * * *